US005390518A

United States Patent [19]

Morimoto et al.

[11] Patent Number: 5,390,518

[45] Date of Patent: Feb. 21, 1995

[54] METHOD FOR SHINING METAL SHEET SURFACES AND METHOD FOR COLD-ROLLING METALLIC MATERIALS

[75] Inventors: Kazuo Morimoto; Hideaki Furumoto; Tetsuo Kajihara; Kanji Hayashi, all of Hiroshima; Atsushi Tomizawa, Osaka; Kiyotaka Hori, Osaka; Toshiya Oi, Osaka; Hideo Yamamoto, Osaka; Masahiro Matsurra, Osaka; Shunji Kamata; Toru Kaneko, both of Ibaragi, all of Japan

[73] Assignees: Mitsubishi Jukogyo Kabushiki Kaisha, Tokyo; Sumitomo Metal Industries, Ltd., Osaka, both of Japan

[21] Appl. No.: 27,241

[22] Filed: Mar. 3, 1993

[30] Foreign Application Priority Data

Nov. 10, 1992 [JP] Japan ..... 4-299621
Nov. 10, 1992 [JP] Japan ..... 4-299683

[51] Int. Cl.[6] ..... B21B 1/24; B21B 37/00

[52] U.S. Cl. ..... 72/10; 72/21; 72/366.2

[58] Field of Search ..... 72/241.2, 241.4, 252.5, 72/366.2, 10, 21

[56] References Cited

U.S. PATENT DOCUMENTS 4,776,192 10/1988 Oda et al. ..... 72/241.4

FOREIGN PATENT DOCUMENTS 0387361 9/1990 European Pat. Off. .
0506138 9/1992 European Pat. Off. .
0045583 3/1980 Japan ..... 72/241.2
0004313 1/1982 Japan ..... 72/241.2
0159202 10/1982 Japan ..... 72/241.4
0006713 1/1983 Japan ..... 72/234
0054121 11/1985 Japan ..... 72/241.2
0169110 7/1986 Japan ..... 72/241.2
2079205 1/1982 United Kingdom .
0791435 12/1980 U.S.S.R. ..... 72/241.2
1222342 4/1986 U.S.S.R. ..... 72/252.5

OTHER PUBLICATIONS

Patent Abstracts of Japan, vol. 10, No. 207 (M-500) 1986 & JP-A-61 049 701 (Nippon Steel), Abstract.
Patent Abstracts of Japan, vol. 5, No. 039 (M-059) 1981 & JP-A-55 165 217 (Ishikawajima Harima), Abstract.
Patent Abstracts of Japan, vol. 9, No. 226 (M-412) 1985 & JP-A-60 83 703 (Mitsubishi) Abstract.
Patent Abstracts of Japan, vol. 11, No. 102 (M-576) 1987 & JP-A-61 249 603 (Nippon Steel), Abstract.

*Primary Examiner*—Lowell A. Larson
*Assistant Examiner*—Thomas C. Schoeffler
*Attorney, Agent, or Firm*—Wenderoth, Lind & Ponack

[57] ABSTRACT

The invention provides a method for improving the luster of a metal sheet surface without deteriorating the productivity and also in reducing the difference in glossiness between the upper and lower surfaces of the metal sheet at the time of cold-rolling. By making the velocity, after rolling of the metal sheet, equal to or larger than the rotational circumferential velocity of the work rolls, and by rolling the metal sheet with upper and lower work rolls crossed with each other in such manner that an angle of slip scratches left on the metal sheet surfaces becomes 5 degrees or larger and shear deformation in the widthwise direction can be effectively given to the metal sheet just before rolling, thereby improving the surface luster of the metal sheet. In addition, in the case where luster of the metal sheet surface is improved by changing the cross angle between the upper and lower crossing work rolls, the sheet configuration is corrected by a configuration control actuator, depending upon the sheet configuration of the metal sheet after the cross angle is changed. Furthermore, the difference in glossiness between the upper and lower surfaces of the metal sheet is reduced by selecting the cross angles formed by the upper and lower crossing work rolls with respect to the direction at right angles to the rolling direction and also employing rolls having different surface roughness as the upper and lower work rolls.

7 Claims, 21 Drawing Sheets

| | |
|---|---|
| WORK ROLL DIAMETER | φ258.2mm |
| WORK ROLL ROUGHNESS | 1 μm Rmax BRIGHT |
| SPECIMEN | SPCC $1^T$ X 300mm |
| LUBRICATING OIL | 100cat 3% EMULSION |
| FORWARD & BACKWARD TENSION | 10/5 kgf/mm$^2$ |
| ROLLING SPEED | 10m/min |
| DEPRESSING PROPORTION % | SYMBOL |
| 20% | ● |
| 30% | ▲ |
| 40% | ■ |

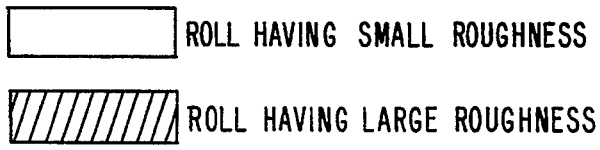
ROLL HAVING SMALL ROUGHNESS
ROLL HAVING LARGE ROUGHNESS
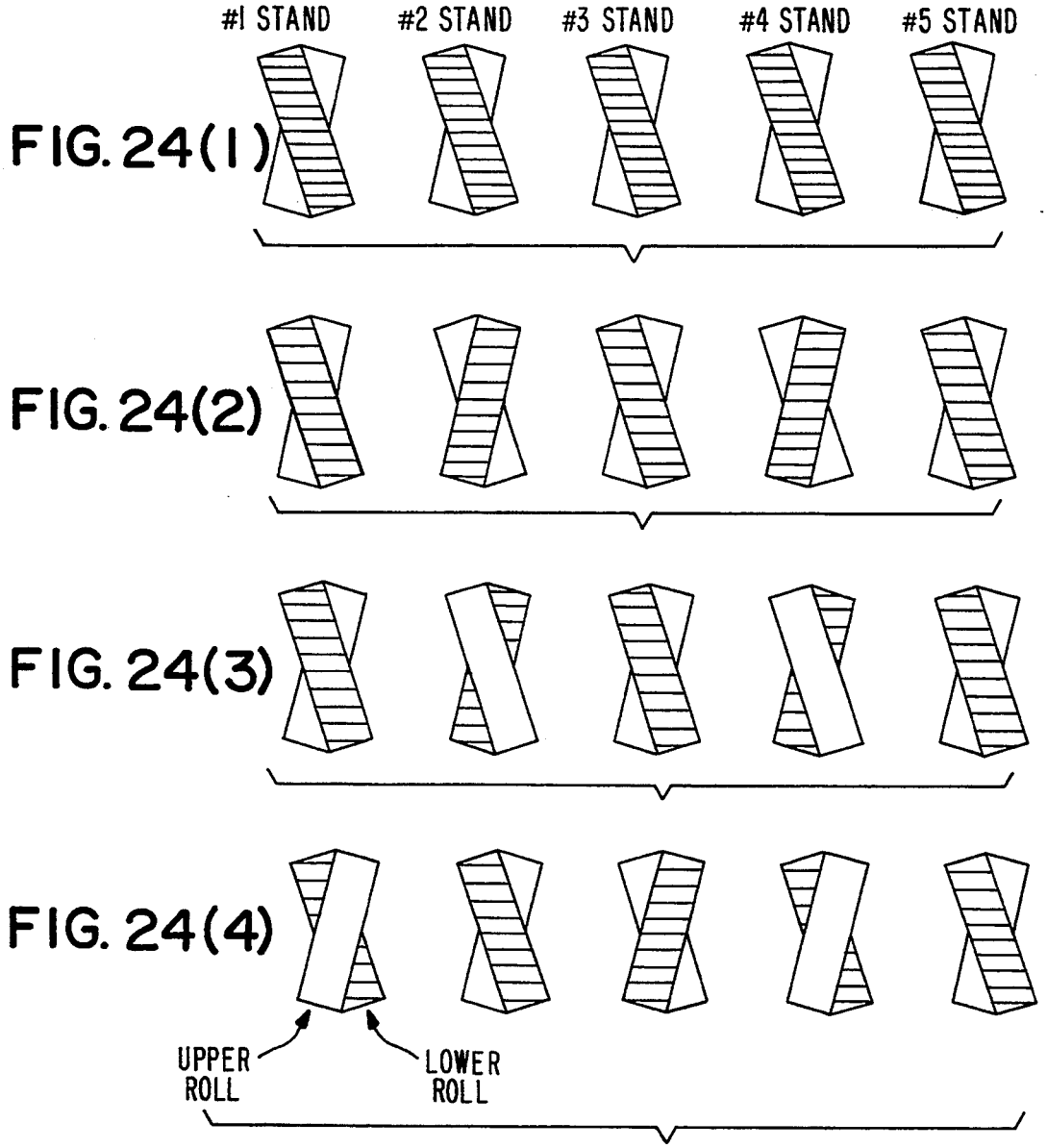
#1 STAND
#2 STAND
#3 STAND
#4 STAND
#5 STAND
FIG. 24(1)
FIG. 24(2)
FIG. 24(3)
FIG. 24(4)
UPPER ROLL
LOWER ROLL

METHOD FOR SHINING METAL SHEET SURFACES AND METHOD FOR COLD-ROLLING METALLIC MATERIALS

BACKGROUND OF THE INVENTION

1. Field of the Invention

The present invention relates to a method for improving surface luster of a metal sheet at the time of cold-rolling and a method for cold-rolling metallic materials so as to improve glossinesses of the both surfaces of metallic materials.

2. Description of the Prior Art

In recent years, demands of users for qualities of rolled sheets of various metals as represented by thin stainless steel sheets (hereinafter described simply metal sheets) have been becoming more and more severe. Above all, with respect to thin stainless steel sheets, those having an especially high glossiness have been demanded.

Luster of a metal sheet surface is influenced mainly by an amount of lubricating oil introduced between a roll and a metallic material during cold-rolling. If amount of lubricating oil is too much, the surface of the metallic material is freely deformed by its static pressure, resulting in occurrence of fine recessed flaws called oil pits, and a glossiness is lowered. Also in the case where lubricating oil having a low viscosity is used or a small amount of lubricating oil is used and thereby metallic contact portions between a metal sheet and a roll are increased, a problem such that a seizure flaw is produced, becomes liable to occur.

Heretofore, as one of cold rolling methods for a metal sheet, a rolling method making use of a cross-roll mill has been known. This rolling method was such method that a pair of work rolls for use in rolling are disposed so as to cross with each other as inclined in the opposite directions to each other with respect to a direction at right angles to a feed direction of a metal sheet forming a material to be rolled, and rolling is effected by pinching and pressing the metal sheet with these work rolls.

And at the time of rolling a metal sheet through such a rolling method, not only a sheet configuration but also quality of luster of the metal sheet surface were taken seriously as a part of quality of the product, but it was difficult to satisfy the both requirements.

In addition, at present, for the purpose of obtaining a metal sheet having a high glossiness, a cold rolling method making use of a mill called "Sendzimir mill" is generally practiced. In this Sendzimir mill, since a diameter of work rolls is small and a rolling speed is slow, excessive lubricating oil would not be introduced into a roll caliber tool, and a metal sheet having a high glossiness can be manufactured. However, cold-rolling by making use of a Sendzimir mill involves the problem that it is inefficient because a rolling pass is repeated by a lever system and a rolling speed is slow due to a small diameter of rolls.

Hence, an attempt at producing metal sheets having a high glossiness more efficiently by making use of a tandem mill capable of carrying out high-speed rolling, has been done. However, if high-speed rolling is effected with a tandem mill having a large roll diameter, there is a problem that an introduced amount of lubricating oil increases and a glossiness is lowered. In order to resolve this problem, in the official gazette of Laid-Open Japanese Patent Specification No. 61-49701 (1986) is disclosed a cold-rolling method, in which after cold-rolling has been carried out by means of a tandem mill provided with work rolls having a large diameter of 150 mm $\phi$ or more, finish rolling is effected by making use of a Sendzimir mill employing small-diameter rolls of 100 mm $\phi$ or less as work rolls, and thereby a thin stainless steel sheet having few surface defects can be obtained. However, since this method necessitates two kinds of installations of a tandem mill and a Sendzimir mill and moreover eventually a Sendzimir mill is used, there still remains a problem that a rolling speed is limited and a productivity is not improved.

On the other hand, in the case of cold-rolling metallic materials, there exists a problem that luster of a metal sheet is different between its upper surface and lower surface because of the fact that an amount of adhesion of lubricating oil does not become equal between the upper and lower surfaces of the metallic material. In general, an upper surface which is rolled under a condition rich in lubricating oil, becomes to have a smaller glossiness. Therefore, in the official gazette of Laid-Open Japanese Patent Specification No. 55-165217 (1980) is disclosed a method for rolling by changing a pass-angle of a metallic material. This method is a rolling method improved so as to reduce an amount of introduced lubricating oil by enlarging a biting angle of an upper surface, but it involved a problem that a space for newly equipping an additional device was necessitated for a mill.

Generally it is known that for the purpose of giving excellent luster to a metal sheet, work rolls to be used for rolling had better have a smaller surface roughness, and a technique of improving luster by making use of work rolls having a large surface roughness is not known.

In the above-described method in the prior art of selecting lubricating oil having a low viscosity or reducing an amount of lubricating oil introduced between a metal sheet and a work roll by making use of work rolls having a small diameter, since a lubricating condition between the metal sheet and the work rolls is deteriorated, the problem that the metal sheet would be overheated due to friction between the metal sheet and the work rolls and seizure would be generated, is liable to occur. Therefore, in the prior art, in the case where it is intended to improve surface luster of a metal sheet, it was necessary to work with a rolling speed lowered.

Therefore, in the industry of cold-rolling a product whose surface luster is deemed to be an important merchandise value such as stainless steel sheets, aluminium sheets, etc., establishment of a rolling method which can improve surface luster while enhancing a productivity was a long-standing problem.

SUMMARY OF THE INVENTION:

The present invention has been worked out in view of the above-mentioned circumstance of the art, and has it as an object to provide a method for shining metal surfaces, in which surface luster can be improved without lowering a productivity.

In the previously described rolling method making use of crossing upper and lower work rolls in the prior art, in the vent that surface luster of a metal sheet does not reach a target value, control for changing a cross angle so as to improve surface luster, is effected. However, change of a cross angle would be necessarily accompanied by deterioration of a sheet configuration of a metal sheet. Accordingly, the prior art involved a problem that it was impossible to simultaneously satisfy the demands for both a surface luster and a sheet configuration of a metal sheet.

Therefore, it is another object of the present invention to provide a method for shining metal sheet surfaces in which the above-mentioned problem in the prior art can be resolved.

Furthermore, it is still another object of the present invention to provide a method for rolling metal sheets having excellent luster equivalent to products manufactured by low-speed rolling in a Sendzimir mill in the prior art, at a high efficiency and without producing a difference in a glossiness between the upper and lower surfaces, through a cold-rolling process making use of a tandem mill having a high productivity.

In order to achieve the above-mentioned objects of the invention, according to novel features of the present invention, a method for shining metal sheet surfaces and a method for cold-rolling metallic materials as described in the following numbered paragraphs are provided:

(1) A method for shining metal sheet surfaces according to the present invention is characterized by the fact that by cold-rolling a belt-like metal sheet with a pair of upper and lower work rolls crossed with each other and by selecting a ratio of a velocity after rolling of the above-mentioned metal sheet with respect to a rotational velocity of the aforementioned work rolls at 1 or more and at $1+0.2\ \theta_c$ or less, shear deformation in the widthwise direction of the sheet is given to the surface of the aforementioned metal sheet, and thereby surface luster of the above-mentioned metal sheet is improved.

(2) A method for shining metal sheet surfaces according to the present invention is a method for shining metal sheet surfaces wherein while a belt-like metal sheet is being cold-rolled as placed between a pair of mutually crossing work rolls, luster of the above-mentioned metal sheet surfaces is improved by changing a cross angle between the above-mentioned work rolls, characterized in that on the basis of a sheet configuration of the above-mentioned metal sheet after change of the above-described cross angle, the sheet configuration of the above-mentioned metal sheet is corrected by means of a configuration control actuator.

(3) The inventors of the present invention have discovered, in the course of research for enhancing a glossiness of a metal sheet, that a glossiness of a metal sheet surface varies depending upon an angle formed between an axial direction of a work roll and a direction at right angles to a rolling direction (hereinafter called "cross angle"), and further have discovered that in the case where a glossiness of a metal sheet is different between its front surface and rear surface, if rolling is effected by making the upper and lower cross angles different, the glossiness can be equalized between the front and rear surfaces.

Hence the method for cold-rolling metallic materials according to the present invention has employed the following constituents (a)–(c):

(a) A method for cold-rolling metallic materials, characterized in that roll cross rolling is carried out by installing work rolls in such manner that within a plane parallel to a rolling plane, angles $\alpha$ and $\beta$ formed by axial directions of the upper and lower work rolls, respectively, with respect to the direction at right angles to the rolling direction may fulfil the conditions of $\alpha\beta\neq0$ and $\alpha-\beta\neq0$.

(b) A method for cold-rolling metallic materials, wherein a difference in a glossiness between the upper and lower surfaces of a metal sheet after the roll cross rolling is measured, and rolling is carried out while adjusting the angles $\alpha$ and $\beta$ as defined in the preceding paragraph (a) so that the difference in the glossiness may be reduced.

(c) A method for cold-rolling metallic materials as described in the preceding paragraph (a) or (b), wherein roll cross rolling is carried out while controlling the angles $\alpha$ and $\beta$ as defined in the preceding paragraph so that the sum of the angles $\alpha$ and $\beta$ may be constant.

(4) The inventors of the present invention have discovered, in the course of research for enhancing a glossiness of a metal sheet, that if roll cross rolling is carried out by employing rolls having different surface roughnesses as the upper and lower work rolls, glossinesses having no difference can be given to the both surfaces of a metal sheet. Furthermore, it has been discovered that under the above-mentioned rolling condition, a difference in a glossiness between the upper and lower surfaces of a metal sheet can be controlled to a high extent by changing the angle formed between the axial direction of the work roll and the direction at right angles to the rolling direction ("cross angle") between the upper and lower work rolls.

Hence, the method for cold rolling metallic materials according to the present invention has employed the following constituents (d)–(h):

(d) A method for cold-rolling metallic materials, wherein roll cross rolling is carried out by making use of work rolls having different surface roughnesses as the upper and lower work rolls.

(e) A method for cold-rolling metallic materials, wherein rolling is carried out by disposing the upper and lower work rolls in such manner that at the time of roll cross rolling as described in the paragraph (d) above, the cross angles of the upper and lower work rolls, respectively, may be different.

(f) A rolling method as described in the paragraph (e) above, wherein glossinesses of the upper and lower surfaces of the metal sheet are measured, and rolling is carried out while adjusting the cross angle between the upper and lower work rolls so that the difference in the glossiness may be reduced.

(g) A rolling method as described in the paragraphs (e)–(f) above, wherein the sum of the upper and lower cross angles is constant.

(h) A rolling method as described in the paragraphs (e)–(f) above, wherein at the time of carrying out roll cross rolling by means of successive stands, surface roughnesses and/or cross-directions of the upper and lower work rolls are alternately interchanged in the respective stands.

Now, an operation principle of the present invention will be described in greater detail.

Generally in cold-rolling, the cause of improvement of surface luster of a metal sheet is considered to be because a metal sheet and a work roll come into metallic contact, hence a surface roughness is reduced and thereby a reflection factor is raised. On the other hand, if lubricating oil is present between a metal sheet and a work roll, a metal surface subjected to plasticity processing due to a pressure of lubricating oil becomes a surface having much unevenness, hence irregular reflection becomes predominant and luster would be lowered. It was because of this reason that heretofore in order to raise a surface glossiness of a metal sheet, an amount of lubricating oil bitten between a metal sheet and a work roll was reduced or a lubricating condition was deteriorated.

The inventors of the present invention have discovered that if it is attempted to make a surface layer of a metal sheet subjected to shear deformation in the widthwise direction by giving a slip component force in the widthwise direction between the metal surface and the roll, then the metal sheet surface and the roll would come into metallic contact, and a metal surface having a high glossiness could be obtained. Even if a sufficient amount of lubricating oil should be present between a metal sheet and a work roll, a similar result was obtained.

Here, since a metal sheet would have its thickness reduced as it is being rolled, and accordingly its velocity would become fast, in the case where a belt-like metal sheet is cold-rolled with a pair of upper and lower work rolls crossed with each other, generally within a rolling deformation region, there exists a point where the velocity of the metal sheet and the rotational velocity of the work roll become equal to each other, and on the inlet side of this point the velocity of the metal sheet is lower than the rotational velocity of the work roll, while on the outlet side, the velocity of the metal sheet is higher than the rotational velocity of the work roll. A slip direction between the rolled metal sheet and the work roll would be directed in the widthwise direction of the sheet at the point where the absolute values of the velocities of the metal sheet and the work roll become equal to each other. Accordingly, in the present invention featured in the paragraph (1) above, the velocity ratio of the velocity after rolling of the above-mentioned metal sheet with respect to the rotational velocity of the work roll was defined to be at least 1 or more.

Furthermore, a surface configuration of a metal sheet is most largely influenced just before finishment of rolling, and even if a shear deformation in the sheet widthwise direction should exist within the rolling deformation range, when the slip direction between the metal sheet and the work roll just before finishment of rolling becomes close to the direction parallel to the rolling direction, eventually the influence of shear deformation would be cancelled. In other words, for the purpose of effectively giving a glossiness, it is desirable to give the shear deformation in the widthwise direction as just as possible before finishment of the rolling.

Here, the distance between the point where the absolute values of velocities of the metal sheet and the work roll become equal to each other and the point of finishment of rolling within a rolling deformation region would become longer as the sheet velocity after rolling becomes faster.

Accordingly, in the present invention as featured in the paragraph (1) above, in order to give shear deformation in the sheet widthwise direction to the sheet surface as just as possible before finishment of rolling, it is desirable to make a sheet velocity after rolling low. When experiments for realizing such results were repeated, it was desirable to select a slip angle $\theta_s$ left on the metal sheet surface at 5 degrees or more, and to that end in the present invention featured in the paragraph (1) above, the above-mentioned velocity ratio of the velocity after rolling of the metal sheet with respect to the rotational velocity of the work roll obtained experimentarily, was set at $1+0.2\ \theta_c$ or less.

In the present invention as featured in the paragraph (2) above, as a result of rotation of a pair of work rolls with a belt-like sheet metal pinched between the work rolls, the metal sheet is cold-rolled and also given luster on its surfaces.

At this time, in the event that a glossiness of the metal sheet surfaces should have been lowered due to external disturbances or the like, the glossiness is improved by changing a cross angle between the cross rolls, a variation of a sheet configuration accompanying this change of the cross angle is fed back, and the sheet configuration is corrected by a configuration control actuator.

Next, the operations of the present invention featured in the paragraphs 3(*a*)–(*b*) above will be explained in greater detail with reference to the accompanying drawings. FIG. 14 is a plan view showing the state of rolling according to the present invention featured in the paragraphs 3(*a*)–(*b*) above (as viewed from the above), in which an angle $\alpha$ formed between a direction at right angles to the rolling direction (a sheet widthwise direction of a metal sheet 203) and an upper work roll 201 and an angle $\beta$ formed between the same sheet widthwise direction and a lower work roll 202 are different. However, the upper cross roll and the lower cross roll could be inclined either in the opposite directions with respect to the sheet widthwise direction as shown in this figure, or in the same direction, but it is desirable to be inclined in the opposite directions because in the case of being inclined in the same direction, zigzag traveling of the metal sheet accompanying the rolling becomes large.

FIG. 15 is a plan view for explaining a conventional roll cross rolling method, in which upper and lower work rolls 201 and 202 are disposed symmetrically with respect to a sheet widthwise direction of a metal sheet 203 (the state of $\alpha=\beta$).

FIG. 16 is a cross-section view in the sheet widthwise direction of a metal sheet 203 for explaining a contact condition between a work roll and the metal sheet.

In the conventional roll cross rolling, as shown in FIG. 15, an upper work roll 201 and a lower work roll 202 are crossed within a plane parallel to a rolling plane so that the respective cross angles may become $\theta$, and a metal sheet 203 is rolled in the direction X. In this rolling, since there exists a deviation of an angle $\theta$ between a rotational circumferential velocity $V_r$ of the upper work roll 201 and a rolling velocity $V_s$ of the metal sheet 203, on the upper surface of the metal sheet 203 there occurs slip in the sheet widthwise direction (the direction Y) between the metallic material and the roll. Likewise since the direction of the rotational circumferential velocity of the lower work roll 202 also has a deviation of an angle $\theta$ with respect to the rolling direction of the metal sheet, on the lower surface of the metal sheet 203 also slip in the sheet widthwise direction occurs between the metallic material and the roll. The shearing stress generated at this time acts in the sheet widthwise direction in the surface layer portion of the metal sheet 203, and due to relative movement with respect to the grinding stripe pattern of the work roll, the surface of the metal sheet 203 is smoothened.

Accordingly, as shown in FIG. 16, if roll cross rolling is carried out by making use of a roll having the conventional grinding stripe pattern (directed in the circumferential direction of the roll), then, for instance, protrusions of the grinding stripe pattern of the upper work roll 201 would move while relatively slipping in the sheet widthwise direction Y with respect to the metal sheet 203. At this time, the protrusions of the upper work roll 201 would grind the surface of the metal sheet 203 and smoothen it. Depending upon the extent of smoothening, luster of the metal sheet surface would vary.

If the axial direction of either one of the rolls is parallel to the sheet widthwise direction, the above-mentioned grinding effect is not present and excellent luster cannot be obtained, and therefore, the cross angles of the upper nor lower surfaces should not be zero. In other words, the cross angles $\alpha$ and $\beta$ of the work rolls are necessitated to fulfil the condition of $\alpha \cdot \beta \neq 0$.

FIG. 17 is illustration of the relations between a cross angle of a work roll and a glossiness of an upper surface of metallic material (SUS 430) after rolling as measured with the feed rate of lubricating oil varied in three steps of 10, 20 and 50 liter/rain, when the conventional roll cross rolling as shown in FIG. 2 was carried out by employing rolls having a surface roughness Ra of 0.2 μm and setting a rolling speed at 100 m/min and at 400 m/min. It is seen that in the range of 0°–1.5° of the cross angle ($\theta$), the larger the cross angle is, the higher is the glossiness, and the more the amount of lubricating oil is, the lower becomes the glossiness. While attention was paid to only an upper surface of a metal sheet here, this relation is also established even if made between an upper surface and a lower surface of a sheet. In other words, generally an amount of lubricating oil bitten at the time of rolling becomes less at a lower surface as compared to an upper surface, and so, a glossiness of an upper surface would be inferior to that of a lower surface. Instead, however, if rolling is effected with the cross angle of the work roll on the upper side set large, a sheet material having excellent luster and having no difference in luster between front and rear surface, can be obtained. Namely, if rolling is carried out by enlarging a cross angle on the surface of the side where luster would be inferior if the conventional roll cross rolling is effected, then a metal sheet having a glossiness not lowered and moreover having no difference in glossiness between the respective surfaces can be produced.

By the way, roll cross rolling has been inherently used as measures for controlling a cross-section configuration of a rolled sheet, and so, if the cross angle is unreasonably varied during rolling, a configuration of a metal sheet would become unstable. However, if arrangement is varied into such arrangement that while the sum of the upper and lower cross angles ($\alpha+\beta$, hereinafter called "cross apex angle") is kept constant, a cross angle of the roll on the side having a lower glossiness (generally the upper roll) may become larger within a plane parallel to the plane of the material to be rolled, then glossinesses of the upper and lower surfaces can be made nearly equal to each other without deforming the configuration of a metal sheet because the distance between the work rolls at the time of rolling is substantially not varied. In FIG. 18 is shown the state where while a cross apex angle is kept constant, the cross angles of the upper and lower rolls are made asymmetric. This figure shows the state where while the cross apex angle ($\alpha+\beta=2\theta$) in FIG. 15 is maintained, the arrangement of the rolls is entirely inclined by an angle $\theta_u$, and the axes depicted by dash lines represent the original symmetric arrangement (the arrangement in FIG. 15).

When the cross angle of the work roll is changed according to the present invention, the work roll could be moved singly, or it could be moved as paired with a backup roll. The latter system is called "pair cross system".

Next, explanation will be made on the present invention featured in the preceding paragraphs 4(*d*)–(*g*). In the present invention featured in the paragraphs 4(*d*)–(*g*) also, crossed upper and lower work rolls having the construction shown in FIG. 14 are used similarly to the present invention featured in the preceding paragraphs 3(*a*)–(*c*).

FIG. 15 is a plan view showing a conventional rolling method in which roll cross rolling is carried out by arranging work rolls so that their cross angles may become symmetric with respect to the sheet widthwise direction. The angle $\alpha$ formed between the direction at right angles to the rolling direction (the sheet widthwise direction) and the upper work roll, and the angle $\beta$ formed between the same sheet widthwise direction and the lower work roll, are equal to each other (the state of $\alpha=\beta=\theta$).

FIG. 14 is a plan view showing the state of carrying out roll cross rolling by arranging upper and lower cross rolls so that their cross angles may be different (the state of $\alpha \neq \beta$). In addition, FIG. 16 is a cross-section view in the sheet widthwise direction for explaining a contact condition between a work roll and a metal sheet.

In the conventional roll cross rolling, as shown in FIG. 15, a metal sheet 203 is rolled in the direction X with an upper work roll 201 and a lower work roll 202 crossed within a plane parallel to the rolling plane so that their respective cross angles may become $\theta$. In this method, since there exists a deviation of an angle $\theta$ between the direction of the rotational circumferential velocity $V_r$ of the upper work roll 201 and the direction of the rolling velocity $V_s$ of the metal sheet 203, on the upper surface of the metal sheet 203 there occurs slip in the sheet widthwise direction (the direction Y) between the metal sheet and the roll. Likewise, since the direction of the rotational circumferential velocity of the lower work roll 202 also has a deviation of an angle $\theta$ with respect to the direction of the rolling velocity of the metal sheet, on the lower surface of the metal sheet 203 also, slip in the sheet widthwise direction occurs between the metal sheet and the roll. The shearing stress generated at this time acts in the sheet widthwise direction at the surface layer portion of the metal sheet 203, and due to displacement with respect to grinding stripe pattern of the work roll, the surface of the metal sheet 203 is smoothened.

Accordingly, if roll cross rolling is carried out by making use of rolls having a conventional grinding stripe pattern (in the circumferential direction of the roll) as shown in FIG. 16, for instance, protrusions of a ground striped pattern of the upper work roll 201 would move while relatively slipping in the sheet widthwise direction Y with respect to the metal sheet 203. At this time, the protrusions of the upper work roll 201 grind the surface of the metal sheet 203 and smoothen it. Luster of a metallic material surface would vary depending upon the extent of this smoothening. This intermetallic contact becomes large as an amount of lubricating oil is reduced or a roughness of the roll is increased. In other words, in the event that glossinesses of the upper surface and the lower surface of a metal sheet are different, by employing a roll having a larger surface roughness than the roll on the opposite side as a roll to be used for the surface having a lower glossiness, the difference in glossiness can be reduced. The difference in the surface roughness between the upper roll and the lower roll should be desirably 0.03 μm or more in terms of the surface roughness Ra. If it is less than 0.03 μm, the effect of the present invention is not sufficient.

FIG. 22 is illustration of the relation between a cross angle of work rolls and a glossiness of an upper surface of a metal sheet after rolling as measure with a feed amount of lubricating oil varied into two kinds of 10 liter/min and 30 liter/min and making use of two kinds of rolls having surface roughnesses in Ra of 0.1 μm and 0.3 μm, when a conventional roll cross rolling as shown in FIG. 15 was carried out under the conditions of rolling speeds of 100 m/min and 400 m/min. The metallic materials used at this time were SUS 430 stainless steel belts, and for the lubricating oil, allay ester group rolling oil having a viscosity of 60 cSt at 40° C. was employed as an emulsion of 3% having a mean particle diameter of 5.5 μm. It is seen that in the range of 0°–1.5° of the cross angle ($\theta$), the larger the cross angle is, the higher is the glossiness, and as the amount of lubricating oil is increased, the glossiness is lowered. It is seen that by changing the surface roughness of the roll, also luster of the metal sheet is varied. While attention was paid to only the upper surface of the metal sheet here, this relation is also valid even if it is compared between the upper and lower surfaces of the sheet. Accordingly, even if the feed amount of lubricating oil should be made equal at the upper and lower surfaces of a metal sheet, a difference would appear in the glossiness obtained for a metal sheet because of the fact that the amount bitten between the roll and the metallic material at the time of rolling is different between the upper and lower surfaces, but if a surface roughness of the roll used for the surface having worse luster is enlarged or if rolling is effected after the cross angle was further adjusted, then a metal sheet having its glossiness not lowered and moreover having no difference in a glossiness between its upper and lower surfaces, can be produced.

By the way, roll cross rolling has been inherently used as measures for controlling a cross-section configuration of a rolled sheet, and so, if the cross angle is unreasonably varied during rolling, a configuration of a metal sheet would become unstable. However, if arrangement is varied into such arrangement that while the sum of the upper and lower cross angles ($\alpha+\beta$, hereinafter called "cross apex angle") is kept constant, a cross angle of the roll on the side having a lower glossiness (generally the upper roll) may become larger within a plane parallel to the plane of the material to be rolled, then glossinesses of the upper and lower surfaces can be made nearly equal to each other without deforming the configuration of the metal sheet because the distance between the work rolls at the time of rolling is substantially not varied. In FIG. 23 is shown the state where while a cross apex angle is kept constant, the cross angles of the upper and lower rolls are made asymmetric. This figure shows the state where while a cross apex angle ($\alpha+\beta=2\theta$) in FIG. 15 is maintained, the arrangement of the rolls is entirely inclined by an angle $\theta_u$, and the axes depicted by dash lines represent the original symmetric arrangement (the arrangement in FIG. 15). Accordingly, in the case where rolling is carried out by varying a cross angle between the upper and lower work rolls in addition to variation of the surface roughnesses of the upper and lower work rolls, it is preferable to carry out rolling without varying a cross apex angle.

BRIEF DESCRIPTION OF THE DRAWINGS:

In the accompanying drawings:

FIGS. 24(*a–d*) are schematic plan views showing arrangements of work rolls in respective stands in a fourth preferred embodiment of the present invention.

DESCRIPTION OF THE PREFERRED EMBODIMENT

In the following, a first preferred embodiment of the present invention will be described in detail with reference to FIGS. 1 to 6.

Figure 1A:
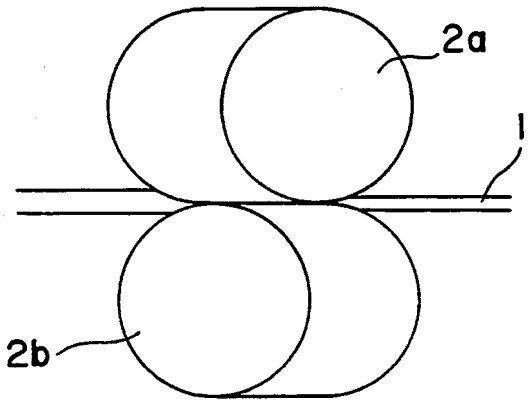
FIGS. 1(*a*) and 1(*b*) are a front view and a plan view conceptionally showing a first preferred embodiment of the present invention, and FIG. 1(*c*) is a schematic view showing relations between slipping directions of a metal sheet and a work roll at an inlet, a neutral point and an outlet, respectively.
Figure 1B:
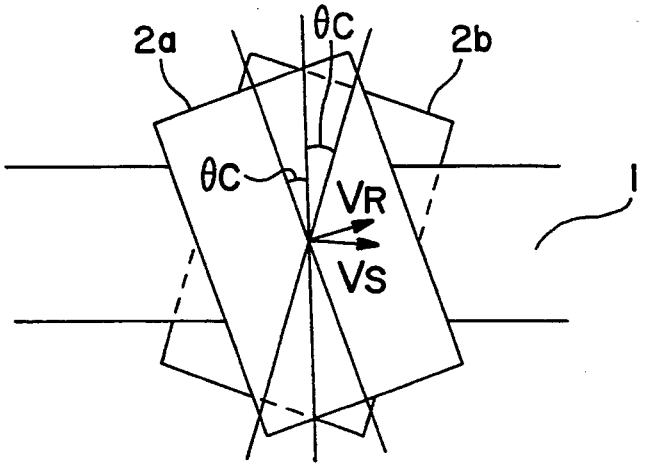
Figure 1C:
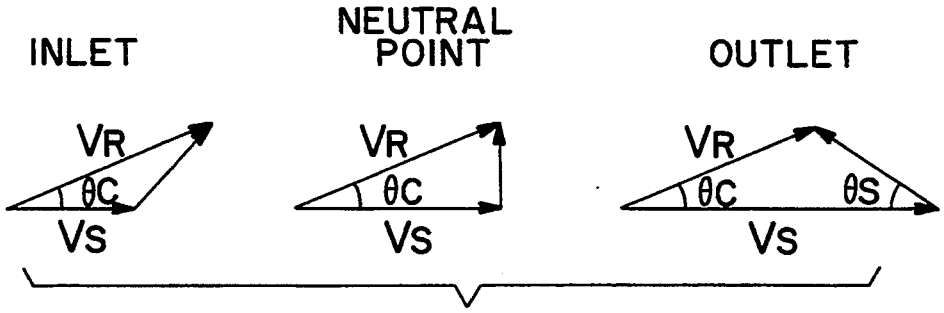

In FIGS. 1(*a*) and 1(*b*) is shown one preferred embodiment of the present invention. As shown in this figure, reference numeral 1 designates a metal sheet, numerals 2*a* and 2*b* designate a pair of work rolls, and the work rolls 2*a* and 2*b* are disposed with the metal sheet 1 pinched therebetween. The rotary axis of the work rolls 2*a* and 2*b* are inclined by an angle $\theta_c$ in the opposite directions to each other with respect to the direction at right angles to a traveling direction of the metal sheet 1 within a horizontal plane. This angle $\theta_c$ is hereinafter called "cross angle $\theta_c$".

If the metal sheet 1 is cold-rolled by the work rolls 2*a* and 2*b* having the above-mentioned construction, the angles formed between the direction of a traveling velocity $V_s$ of the metal sheet 1 and the directions of rotational velocities $V_R$ of the work rolls 2*a* and 2*b*, respectively, become equal to the cross angle $\theta_c$. As the metal sheet is being rolled, its thickness is decreased, and in accordance therewith the velocity becomes fast. In general, within a rolling deformation region there exists a point where the velocity $V_s$ of the metal sheet and the rotational velocity $V_R$ of the work rolls become equal to each other, this point is called "neutral point", and in the region on the inlet side of this point the relation of $|V_s|<|V_R|$ is fulfilled while in the region on the outlet side of this point the relation of $|V_s|>|V_R|$ is fulfilled. These regions are called, respectively, "retarded traveling region" and "advanced traveling region".

Accordingly, the directions of slipping between the metal sheet and the work rolls on the inlet side, at the neutral point and on the outlet side would become as shown in FIG. 1(*c*), and it is seen that a slip component in the sheet widthwise direction is larger as the position becomes closer to the neutral point, and as the advanced traveling region becomes longer, the slipping effect in the sheet widthwise direction on the outlet side becomes smaller.

In order to quantitatively confirm the abovedescribed effects, rolling tests were conducted by means of a four-stage test rolling mill including the abovedescribed work rolls 2*a* and 2*b*, and an angle of slipping $\theta_s$ left on the metal sheet surface and a glossiness $G_s$ were measured. This angle $\theta_s$ is hereinafter called "slip angle $\theta_s$". The diameter of the work rolls 2*a* and 2*b* was chosen to be 260 mm, the surface roughness was assumed to be 1 $\mu m$ $R_{max}$, as a specimen a SPCC material of 0.5 mm in thickness was employed, a depression proportion was chosen to be 30%, and a roll velocity $V_R=10$ m/min was employed. As the cross angle $\theta c$, 0.6 degrees and 0.3 degrees were chosen.

Figure 2:
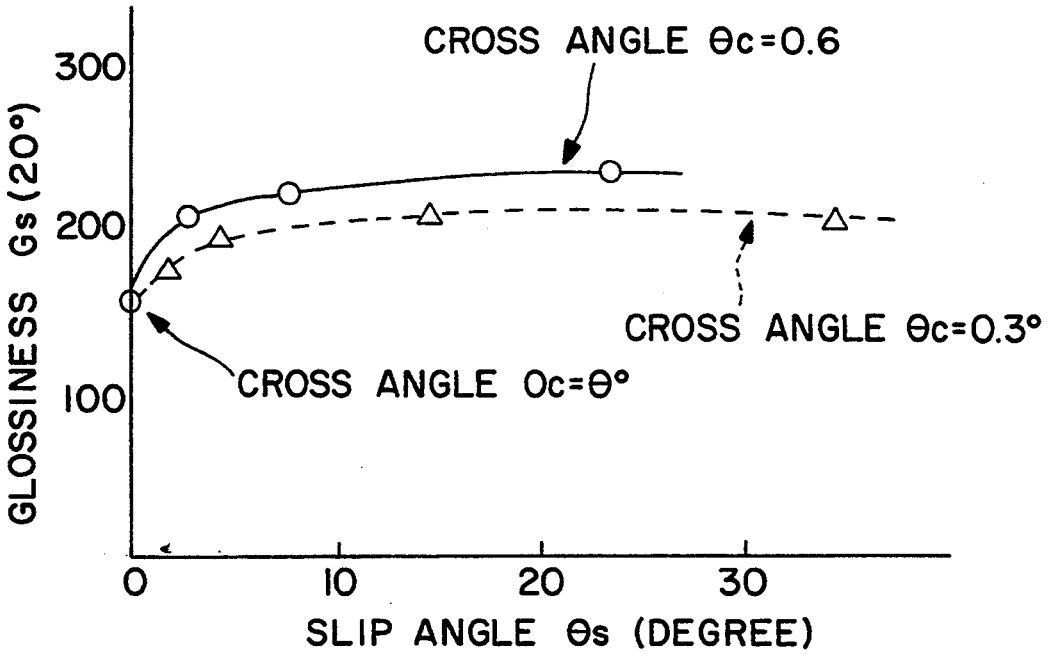
FIG. 2 is a diagram showing relations between a slip angle and a glossiness.

The results are shown in FIG. 2. As shown in the figure, if the slip angle $\theta_s$ becomes 5 degrees or more, a glossiness is improved and takes a constant value, and so, if rolling is carried out within this scope, a good surface glossiness can be maintained constant.

On the other hand, among the slip angle $\theta_s$, the cross angle $\theta_c$ and a velocity ratio $f_s$ of the metal sheet velocity $V_s$ after rolling to the rotational velocity $V_R$ of the work rolls ($=V_s/V_R$), there exists the following relation ( See FIG. 1(*c*)):

$$\sin\theta_s=\sin\theta_c\,(f_s^2+1-2f_s\cos\theta_c)^{\frac{1}{2}} \quad (1)$$

Figure 3:
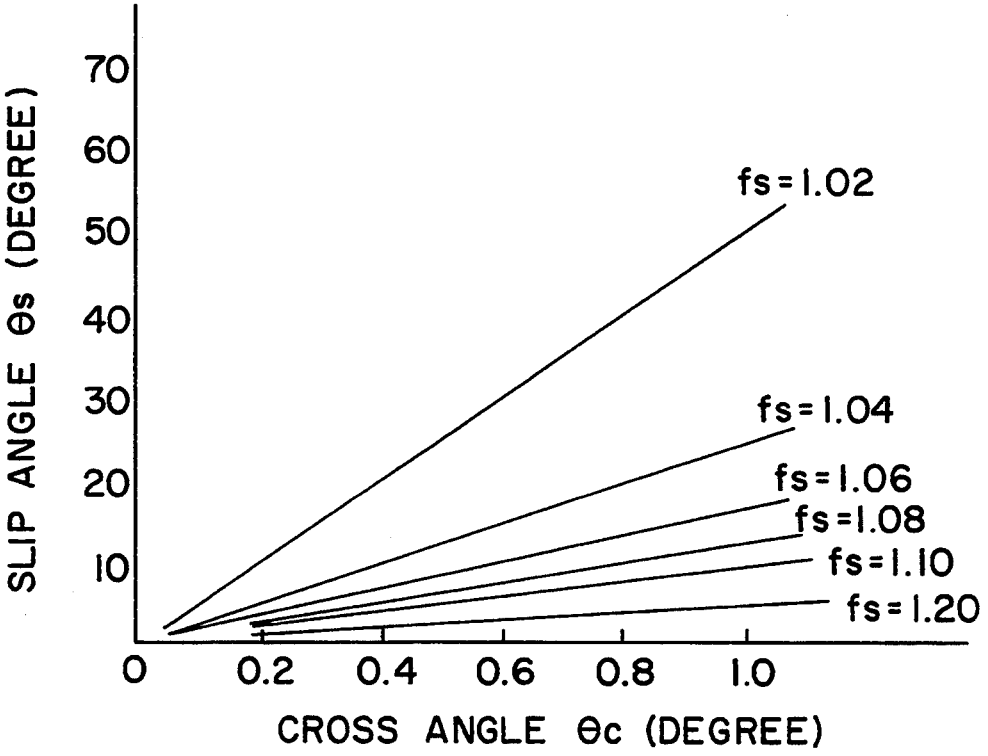
FIG. 3 is a diagram showing relations between a cross angle and a slip angle.
Figure 4:
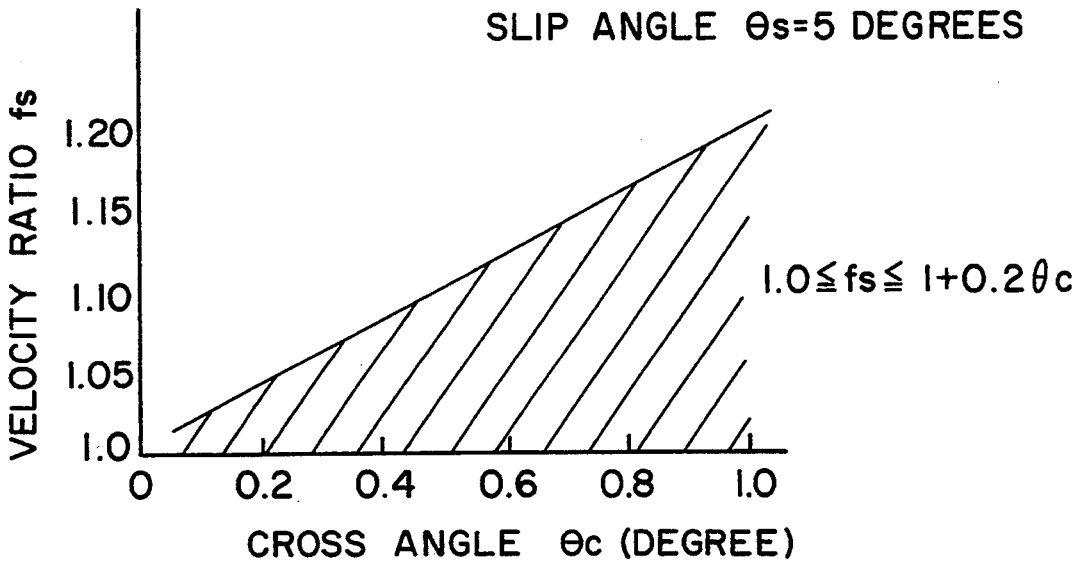
FIG. 4 is a diagram showing a relation between a velocity ratio and a cross angle.

Accordingly, if the relation of the slip angle $\theta_s$ with respect to the cross angle $\theta_c$ is diagramatically shown taking the velocity ratio $f_s$ as a parameter, the relations as shown in FIG. 3 are present. In this figure, a condition of the velocity ratio $f_s$ for making the slip angle $\theta_s$ to be 5 degrees or more, can be represented as a function of the cross angle $\theta_c$ as shown in FIG. 4.

In other words, a formula for giving a shear deformation in the widthwise direction necessitated for the purpose of improving a surface glossiness of a metal sheet and preventing it from varying even under some external disturbances, in other words, for the purpose of applying slip scratches of a slip angle $\theta_s$ of 5 degrees or more to the sheet surface, becomes as follows:

$$1\leqq f_s\leqq 1+0.2\cdot\theta_c \quad (2)$$

Figure 5:
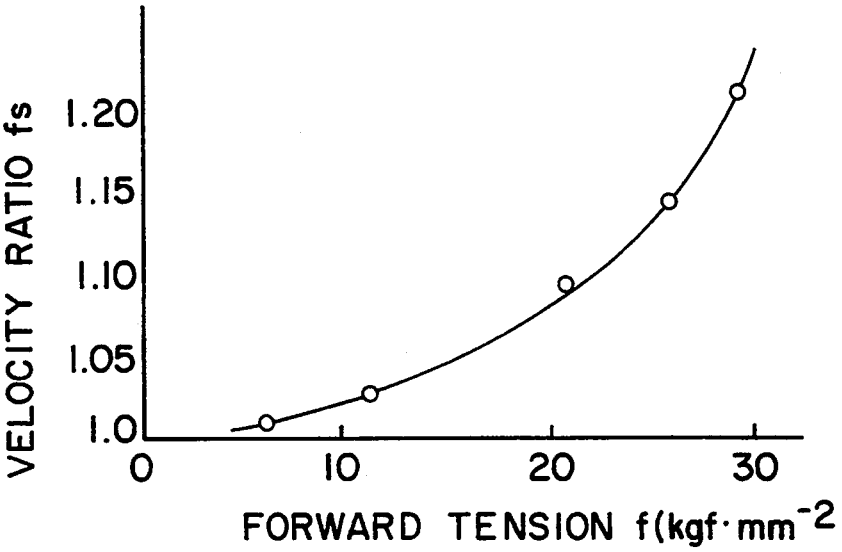
FIG. 5 is a diagram showing a relation between a velocity ratio and a forward tension.

As a method for controlling so that the velocity ratio $f_s$ may fall within the scope represented by the above inequality, various methods such as (1) varying a tension condition, (2) varying a coefficient of friction, (3) varying a depressing proportion, or the like, can be employed. For instance, the data shown in FIG. 2 were such that the velocity ratio $f_s$ was varied by changing a forward tension $\sigma_f$ at the time of rolling. The relation between the forward tension $\sigma_f$ and the velocity ratio $f_s$ is such that as shown in FIG. 5, if the forward tension of $\sigma_f$ increases, the velocity ratio $f_s$ increases non-linearly. Accordingly, it is seen that in the case of the cross angle $\theta_c=0.5$ degrees under the rolling condition used in the experiment as shown in FIG. 5, that is, in order to realize the relation of $1\leqq f_s\leqq 1.10$ the forward tension $\sigma_f$ could be about or lower to 23 kg/mm$^2$.

Figure 6:
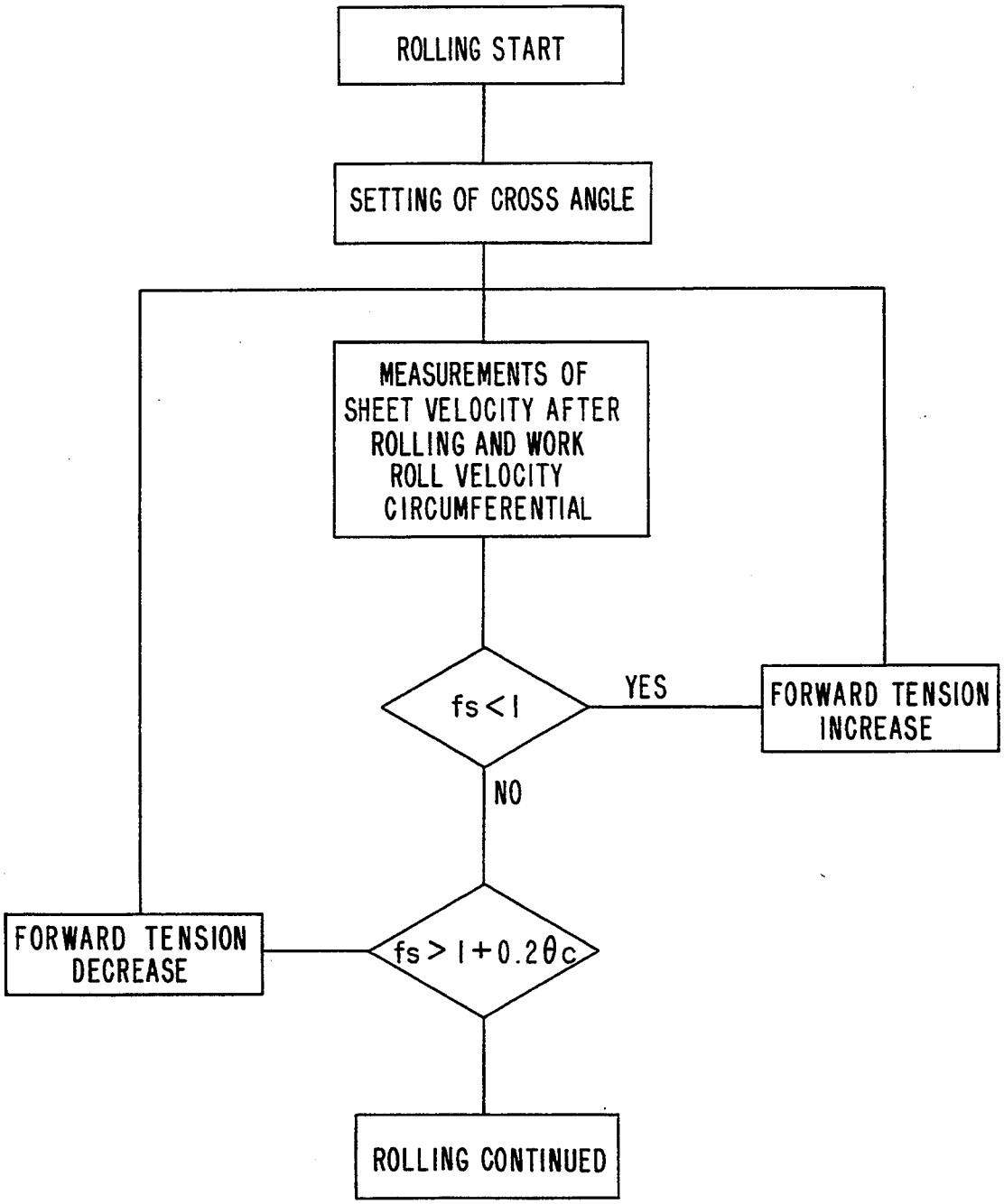
FIG. 6 is a flow chart showing a flow of control in the first preferred embodiment.

A detailed example of control is shown in FIG. 6. With reference to FIG. 6, in the event that a velocity ratio $f_s$ is not present in a predetermined range, the velocity ratio $f_s$ is controlled by increasing or decreasing a forward tension. More particularly, after start of rolling, at first a cross angle is set, subsequently a velocity $V_s$ after rolling of a metal sheet and a rotational circumferential velocity $V_R$ of work rolls are measured, and a velocity ratio $f_s$ ($=V_s/V_R$) is calculated. In succession, while controlling in such manner that in the case where the velocity ratio $f_s$ is smaller than 1, the forward tension may be increased, but on the contrary in the case where the velocity ratio is larger than $1+0.2\,\theta_c$, the forward tension may be decreased, the rolling is continued.

A rolling apparatus and the like used in a method for shining metal sheet surfaces according to a second preferred embodiment of the present invention are illustrated in FIGS. 7 to 13, and description will be made on this second preferred embodiment with reference to these figures.

Figure 7:
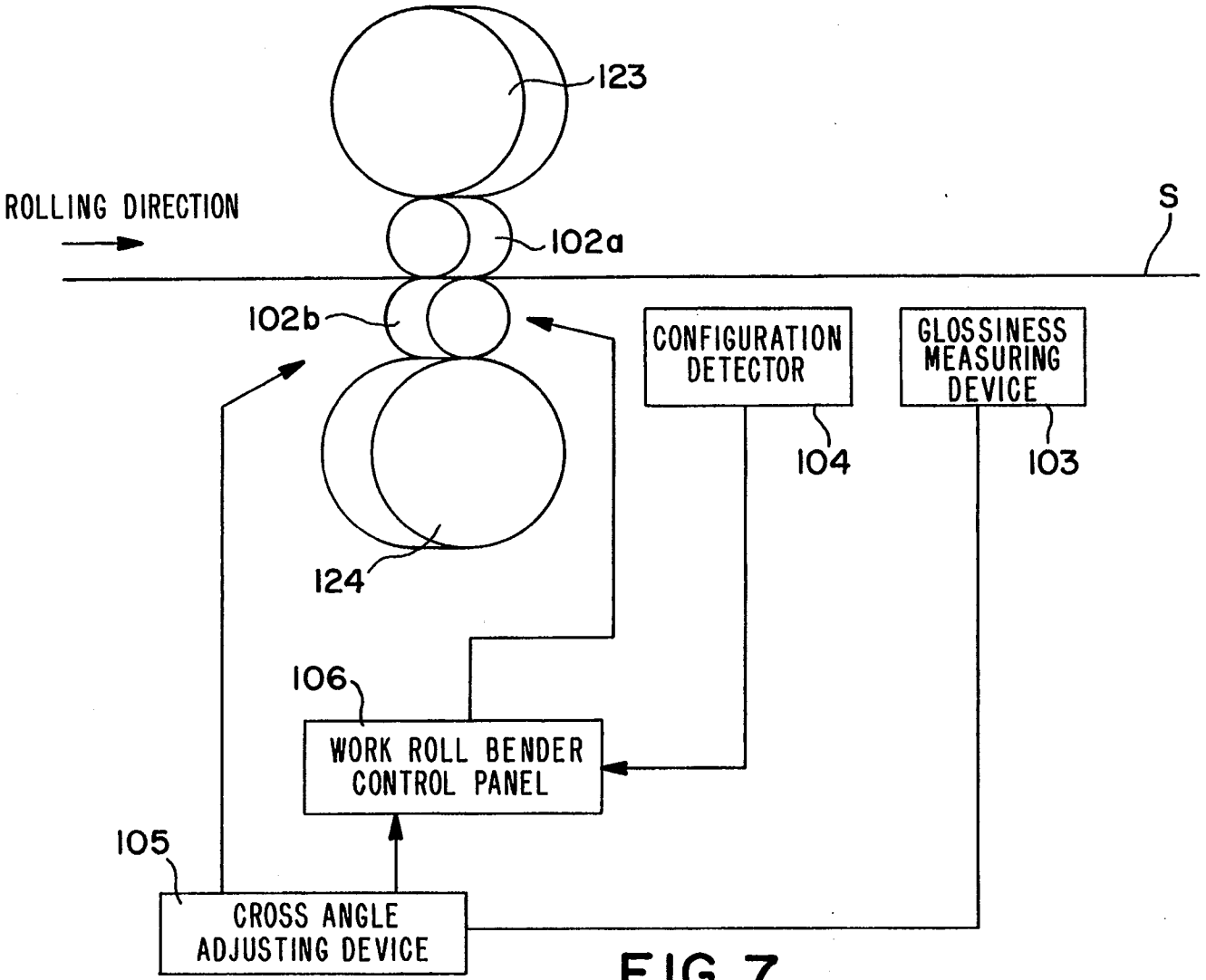
FIG. 7 is a general block diagram of a control system according to a second preferred embodiment of the present invention.
Figure 8:
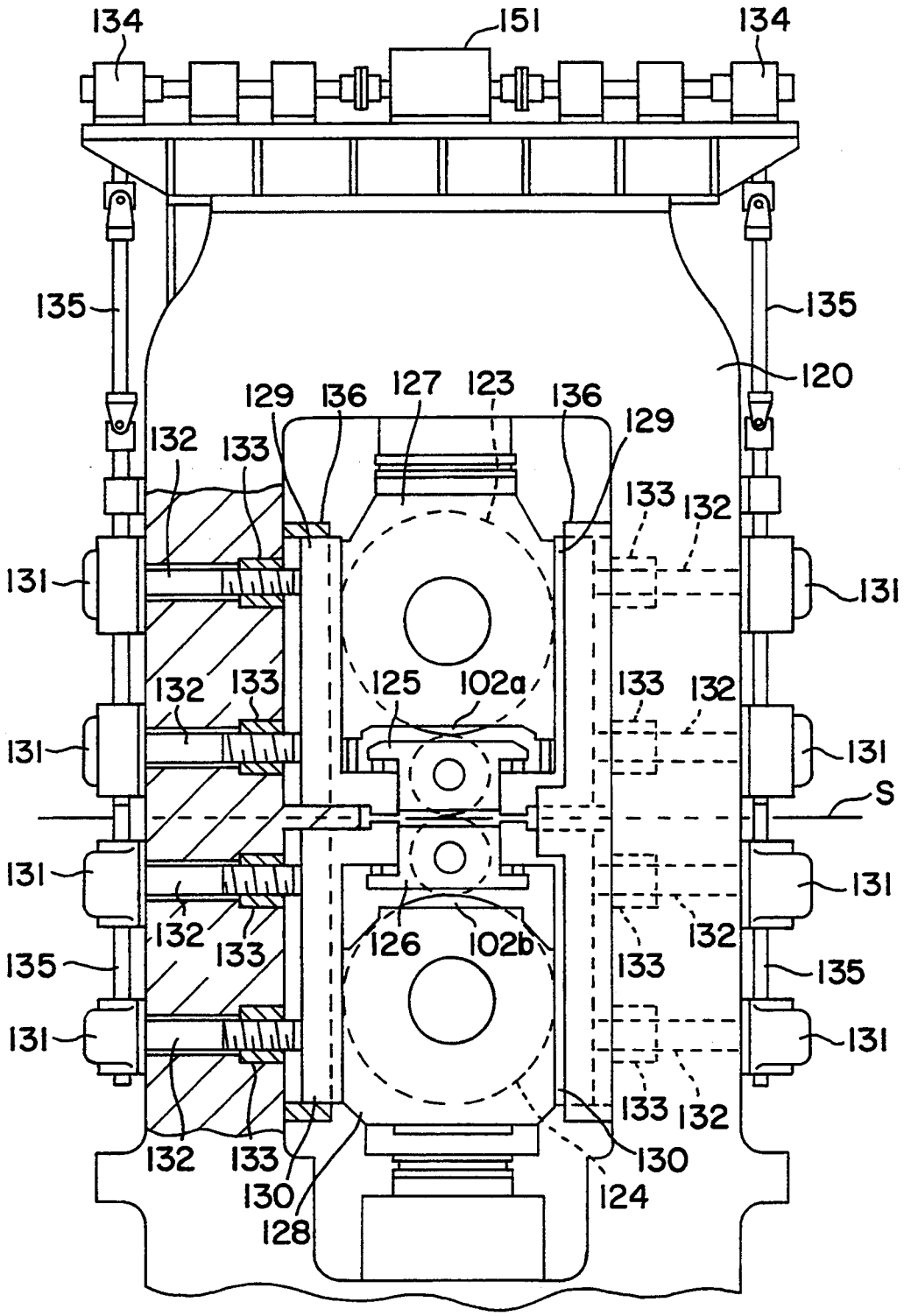
FIG. 8 is a side view showing an essential part of a cross-roll mill according to the second preferred embodiment.
Figure 9:
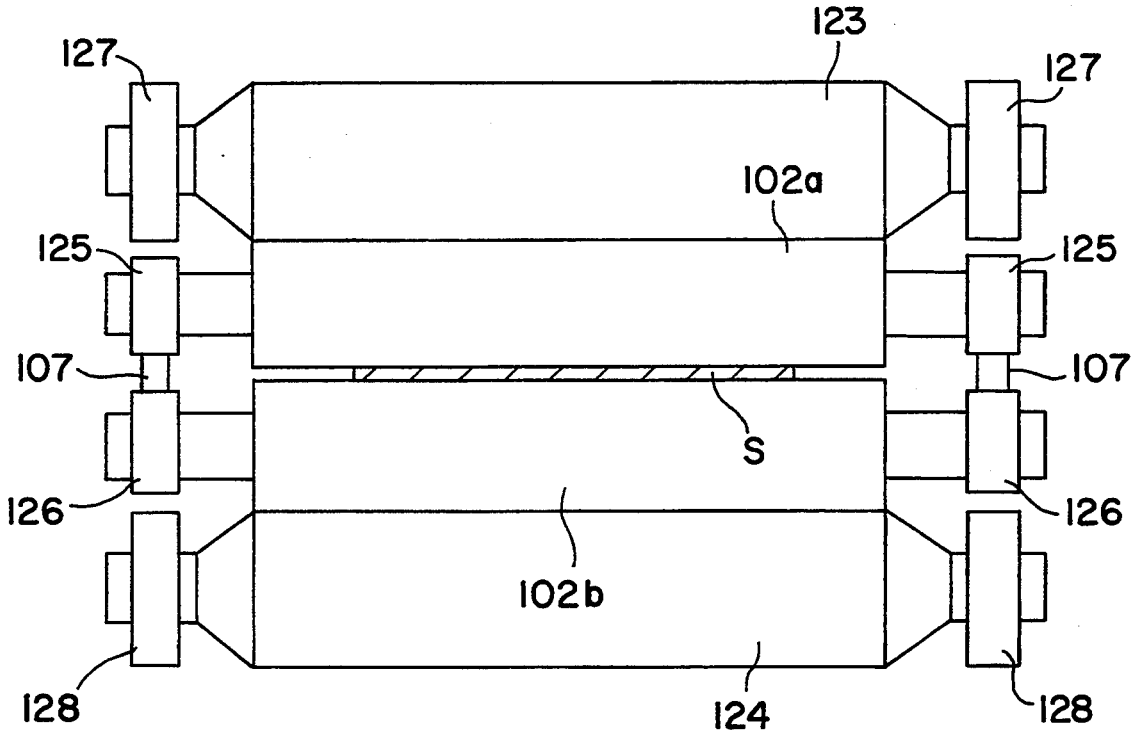
FIG. 9 is a front view showing an essential part of a cross-roll mill according to the second preferred embodiment.

Here, FIG. 7 is a schematic block diagram of a control system according to the second preferred embodiment, FIG. 8 is a side view showing an essential part of a cross roll mill to which the second preferred embodiment is applied, and FIG. 9 is a front view showing an essential part of a cross roll mill to which the second preferred embodiment is applied.

As shown in these figures, an upper cross head 129 and a lower cross head 130 fitted in guides 136 are moved along the direction of a pass line in the opposite directions to each other by rotating respective shafts 135 on the both sides via bevel gears 134 by means of respective motors 151 and thereby rotating screw shafts 132 threadedly mated with nuts 133 via respective worm speed reduction gears 131.

As a result of movement of these both upper and lower cross heads 129 and 130, an upper work roll chock 125 and an upper backup roll chock 127 as well as a lower work roll chock 126 and a lower backup roll chock 128 would rotate in the opposite directions to each other about the center in the roll axial direction of the both upper and lower work rolls 102*a* and 102*b* to make the upper work roll 102*a* and the upper backup roll 123 cross with the lower work roll 102*b* and the lower backup roll 124.

In addition, during rolling, a sheet configuration of a rolled material S is regulated by such adjustment of a cross angle and by adjustment of a hydraulic pressure in work roll bender cylinders 107 of the both upper and lower work rolls 102*a* and 102*b*.

In other words, the upper and lower work rolls 102*a* and 102*b* pinching a material to be rolled S have rotary axes extending within a plane parallel to the plane formed by the surface of the rolled material S, and also these axes are positioned as inclined by an angle $\theta$ in the opposite directions to each other with respect to a direction at right angles to the rolling direction of the rolled material S. Furthermore, this angle $\theta$ can be varied even during rolling by rotation of the screw shafts 132 accompanying the rotation of the motor 151 as described above.

On the other hand, as shown in FIG. 7, on the basis of reflection light from the rolled material S after having been rolled by the work rolls 102*a* and 102*b*, a glossiness is measured by a glossiness measuring device 103, and also a sheet configuration is measured by means of a configuration detector 104. And, the measured value of a glossiness is sent to a work roll bender control panel 106 for controlling operations of the work roll bender cylinder 107, and the measured value of a sheet configuration is sent to a cross angle adjusting device 105 for varying the cross angle.

Accordingly, if a glossiness of the rolled material S deviates from a target value, change of a cross angle is effected by the cross angle adjusting device for rotationally driving the motor 151. In addition, the signal issued from the glossiness measuring device 103 is sent via the cross angle adjusting device 105 to the work roll bender control panel 106. Consequently, the work roll bender control panel 106 controls a hydraulic pressure in the work roll bender cylinder 107 on the basis of the signal input from the configuration detector 104 and the signal input from the glossiness measuring device 103.

Here, description will be made on the relation between a cross angle defined as an angle formed between a pair of crossing work rolls 102*a* and 102*b* and a gap distance between the rolls, and the relation between a surface glossiness of a rolled material S and a sheet configuration.

In other words, adjustment of a cross angle in the rolling method for rolling a rolled material S consisting of a belt-like metal sheet by making a pair of upper and lower work rolls 102*a* and 102*b* cross with each other, would influence not only a glossiness of a metal sheet surface but also a sheet configuration. The reason for this influence is because if a pair of work rolls 102*a* and 102*b* are crossed with each other, then a gap distance between the respective rolls 102*a* and 102*b* would vary along the axial direction of the roll, as the position separates from the centers of the work rolls 102*a* and 102*b* in the widthwise direction, the gap distance becomes larger than the initial set value of the gap distance (the gap distance between the work rolls in the case where the roll axes are parallel to each other), and the gap distance presents a gap distance distribution approximately similar to a parabolic distribution.

Accordingly, if the gap distance distribution at the time when the work rolls 102*a* and 102*b* were crossed by an angle $\theta$ with respect to the direction at right angles to the rolling direction in the opposite direction to each other so that the cross angle of the upper and lower work rolls 102*a* and 102*b* may become an angle $2\theta$, is considered to be equivalent to deformation of the surfaces of the work rolls into a convexity shape along the widthwise direction, the configuration of this work roll surface is represented by the following formula (2) for calculating an amount of convextiness $\delta$:

$$\delta=(y \tan \theta)^2/(Dw+S_o) \quad (2)$$

where symbol y represents a distance from the center in the roll widthwise direction, symbol Dw represents a diameter of a work roll, and symbol $S_o$ represents a roll gap distance at the center of the roll. Accordingly, a value of the amount of convextiness $\delta$ at the point of a distance y can be calculated by the formula (2).

Here, if rolling is effected with a pair of upper and lower work rolls 102*a* and 102*b* crossed with each other, then within a rolling deformation range, a shear deformation in the sheet widthwise direction arises on the surface of the rolled material S, and by leaving this influence on the surface of the rolled material S after rolling, a surface glossiness of a rolled metal sheet can be improved. Accordingly, in order to fully reveal this effect, it is necessary to control the velocity ratio $f_s$ defined as a ratio of the sheet velocity after rolling to the work roll rotational velocity within a range where it depends upon a cross angle, but depending upon a condition for rolling operations, the value of this velocity ratio $f_s$ could be, in some cases, deviated from the above-mentioned target range. At this time, in order to maintain the surface glossiness at a target range, it is necessary to vary the cross angle, but if the cross angle is varied, the gap distance between the work rolls would vary, and so a sheet configuration would be deteriorated.

In the case where the value of the velocity ratio $f_s$ does not vary at this time, in order to control a surface glossiness of a sheet it is essential necessary to vary a cross angle, but as a configuration control actuator for controlling a sheet configuration, for example, bending of work rolls, shift of work rolls or intermediate rolls, backup rolls capable of varying a crown (for instance, VC rolls, TP rolls, sleave rolls, etc.) are known.

Accordingly, a sheet configuration deteriorated in the case where the cross angle between the work rolls was varied for the purpose of obtaining a necessary glossiness, can be improved by measuring a sheet configuration and feeding back the measured value to the work roll bender cylinder 107 serving as one of configuration control actuators.

Figure 10:
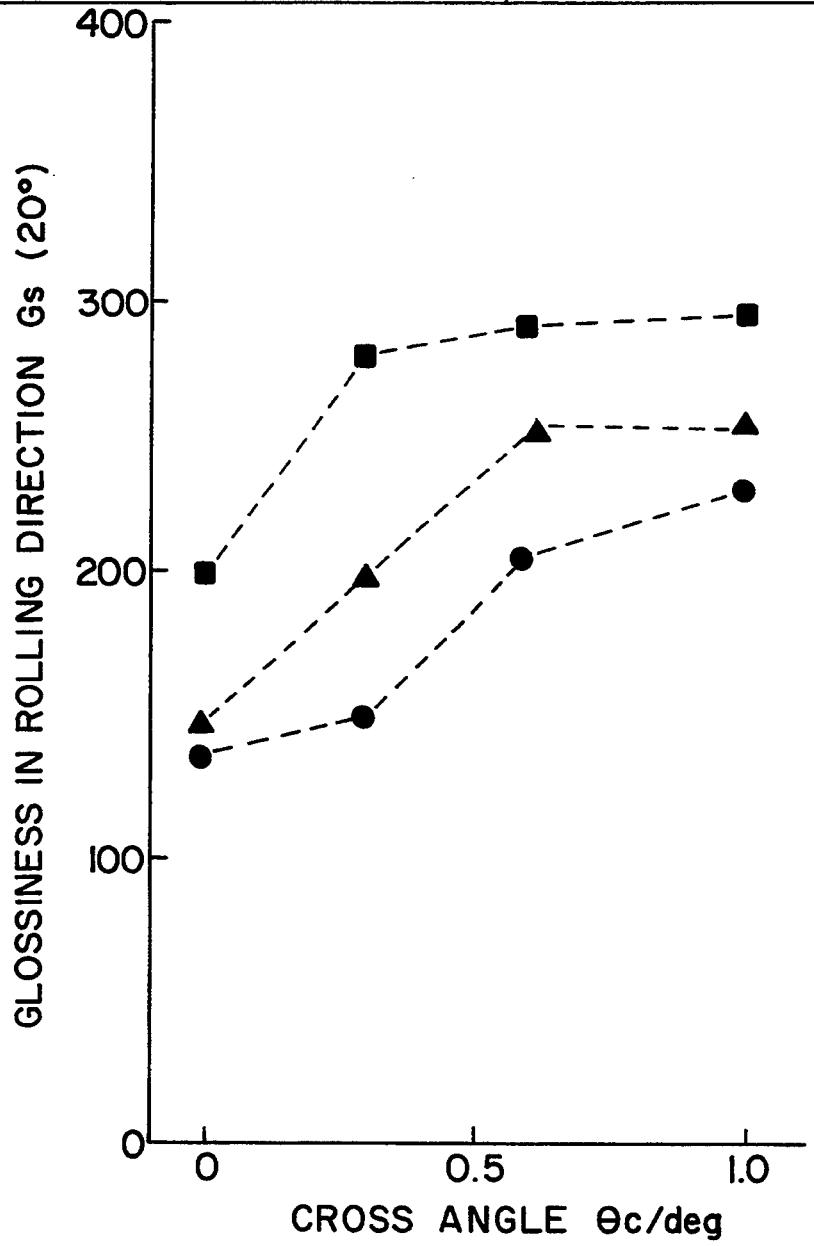
FIG. 10 is a diagram showing relation between a cross angle and a glossiness of a sheet.
Figure 11:
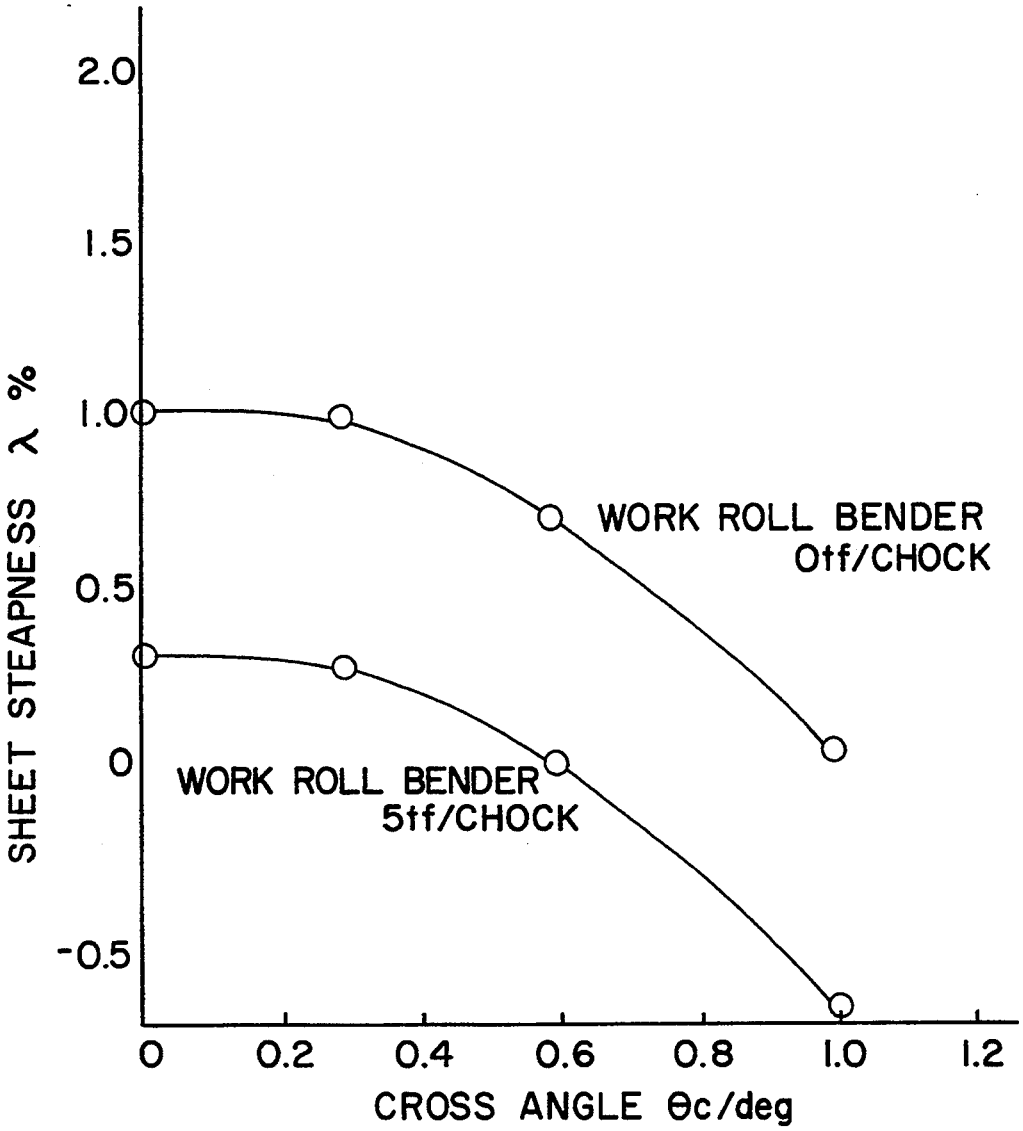
FIG. 11 is a diagram showing relations between a cross angle and a sheet configuration under the same rolling condition as that in FIG. 4.
Figure 12:
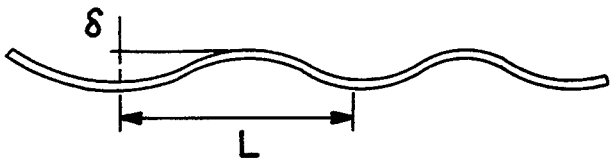
FIG. 12 is a schematic view showing a method for measuring a sheet configuration of a rolled material.

In the following, description will be made on variations of a glossiness and a sheet configuration in the case of varying a cross angle, with reference to FIGS. 10 to 12. In FIG. 10 is shown a diagram representing relations between a cross angle $\theta_c$ and a glossiness $G_s$ of a sheet, in FIG. 11 is shown a diagram representing relations between a cross angle $\theta_c$ and a sheet configuration under the same rolling condition as that shown in FIG. 10, and in FIG. 12 is shown a method for measuring a sheet configuration.

More particularly, a steepness $\lambda$ of a sheet representing a sheet configuration of a rolled material S is defined as $\lambda=\delta/L$ in terms of a height $\delta$ and a pitch L generated in the rolled material S. And a value of the steepness in the case where a wave is present at an end of a sheet is represented as $+\delta$ in FIG. 11 and is also defined as terminal elongation, while a value of the steepness in the case where a wave is present at the center of a sheet is represented as $-\lambda$ in FIG. 11 and is also defined as middle elongation.

As shown in these figures, if a cross angle is made large, a glossiness becomes high, and a sheet configuration tends to change from terminal elongation to middle elongation. And in FIG. 11 is also shown a sheet configuration at the time when a work roll bender force was changed, and it can be seen that if a work roll bender force is made large, a sheet configuration tends to change to middle elongation.

From the above-mentioned facts, the operations and effects of the method according to this preferred embodiment are considered to be the following. That is, a glossiness of a rolled material S is measured by a glossiness measuring device 103, and for instance, in the event that the really measured glossiness is smaller than a target value, variation of a cross angle is effected so as to enlarge the cross angle by means of the cross angle adjusting device 105. Though there exists a possibility that thereby a configuration of the sheet is changed towards middle elongation, the configuration is really measured by the configuration detector 104, and in the event that the middle elongation exceeds a tolerable limit, a hydraulic pressure in the work roll bender cylinder 107 is lowered by the work roll bender control panel 106 so that a work roll bender force may be decreased.

Figure 13:
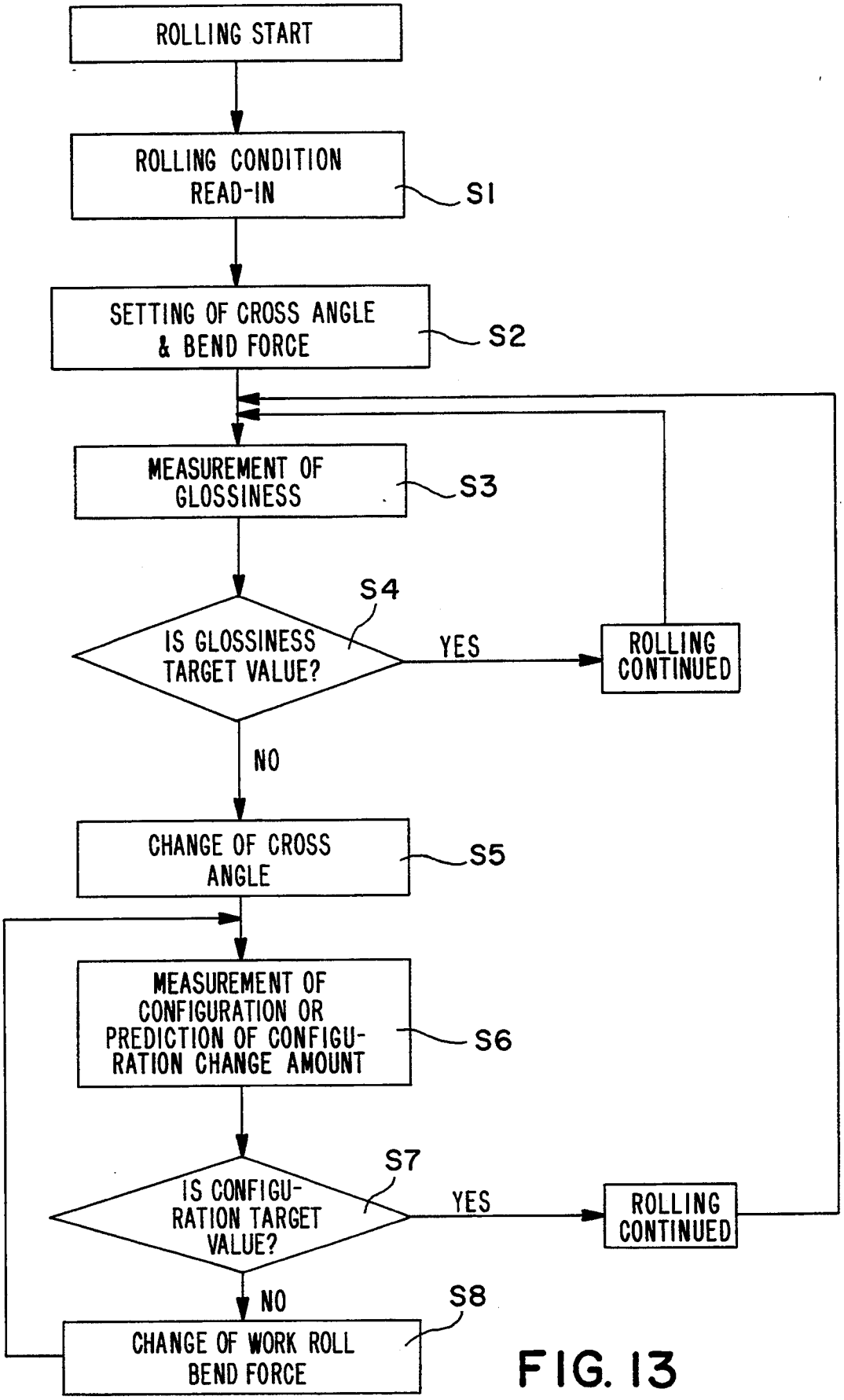
FIG. 13 is a control flow chart according to the second preferred embodiment, showing a flow for controlling a glossiness and a sheet configuration by changing a cross angle and a work roll bend force.

Now, description will be made on detailed operations and effects of the above-described second preferred embodiment of the present invention with reference to a control flow chart in FIG. 13.

At first, when rolling has been started, in a step S1 read-in of rolling conditions such as a rotational velocity of work rolls and the like into the cross angle adjusting device 105 is effected, in a step S2 setting of a cross angle and a bend force is carried out, and in a step S3 measurement of a glossiness of a rolled material S by the glossiness measuring device 103 is carried out. Furthermore, in a step S4 it is judged by the cross angle adjusting device 105 whether or not the glossiness falls in a predetermined target value range, and if it falls in the range, rolling is continued and the operation returns to the step S3. On the other hand, if the glossiness does not fall in the target value range, in a step S5 change of a cross angle is effected.

Thereafter, in a step S6 measurement of a sheet configuration by the configuration detector 104 or prediction of a changed amount of a sheet configuration by the cross angle adjusting device 105 is carried out. And in a step S7 it is judged by the cross angle adjusting device 105 whether or not the sheet configuration falls in a predetermined target value range, and if it falls in the range, rolling is continues and the operation returns to the step S3. On the other hand, if the sheet configuration does not fall in the target value range, the operation transfers to a step S8, and in this step S8 the work roll bender cylinder 107 is operated by the work roll bender control panel 106, thereby a sheet configuration is adjusted, and the operation returns to the step S6.

Through the above-mentioned operations, it becomes possible to improve a glossiness while maintaining a sheet configuration of a rolled material S.

Figure 19:
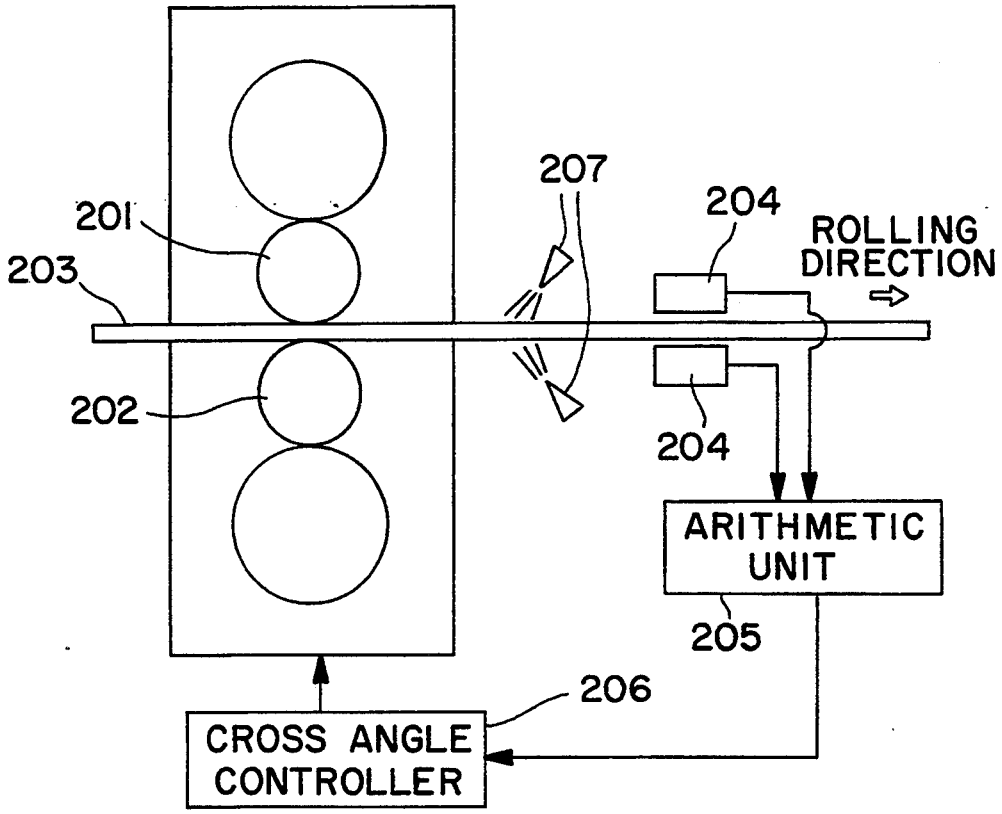
FIG. 19 is a block diagram showing one example of the method according to third and fourth preferred embodiments of the present invention, in which glossinesses of upper and lower surfaces are measured and cross angles are set on the basis of a .difference between the measured glossinesses.

A third preferred embodiment of the present invention will be explained-in the following. This third preferred embodiment is an embodiment of the present invention described in the previous numbered paragraphs 3(*a*)–(*c*), which employs the system shown in FIG. 19 in the coldrolling method making use of the apparatus shown in FIG. 14. As shown in FIG. 19, glossinesses of upper and lower surfaces of a metal sheet after rolling are measured by glossiness meters 204, then glossinesses of the upper and lower surfaces obtained as a result of the measurements are respectively input to an arithmetic unit 205, in which calculation is effected to obtain a glossiness difference, and a cross angle is changed so as to reduce the difference to zero. A controller 206 is a device for controlling the cross angle according to an amount of change of the cross angle calculated on the basis of the glossiness difference.

Figure 14:
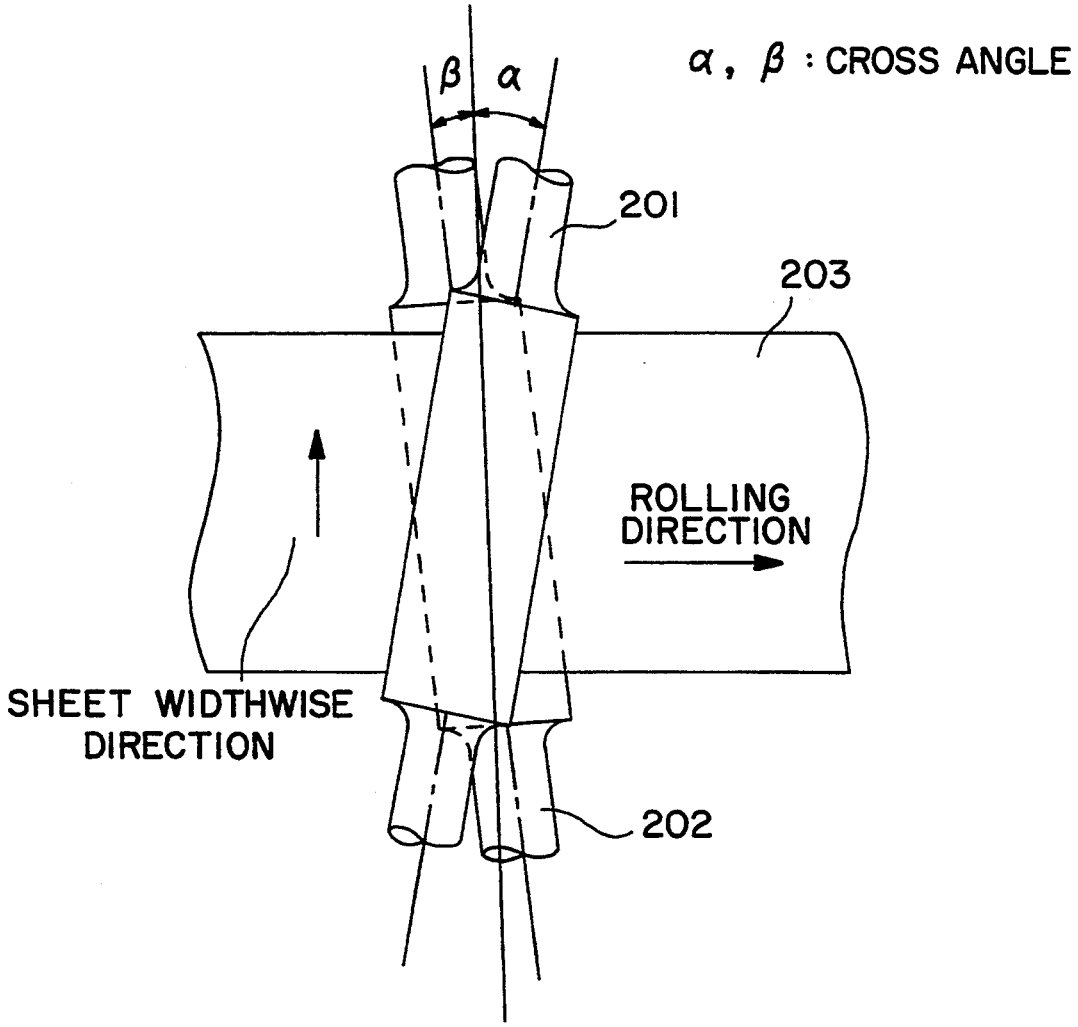
FIG. 14 is a plan view showing a state of rolling through the method according to the present invention.
Figure 15:
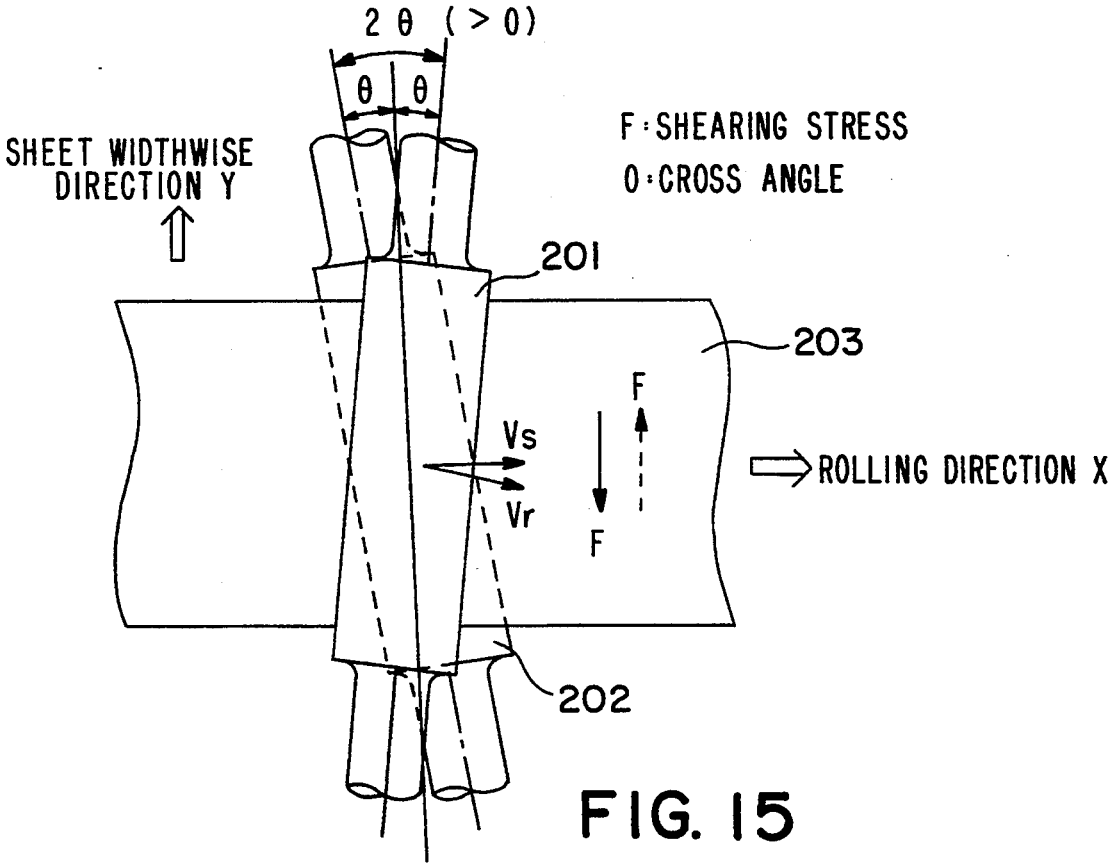
FIG. 15 is a plan view for explaining a roll cross rolling method.
Figure 16:
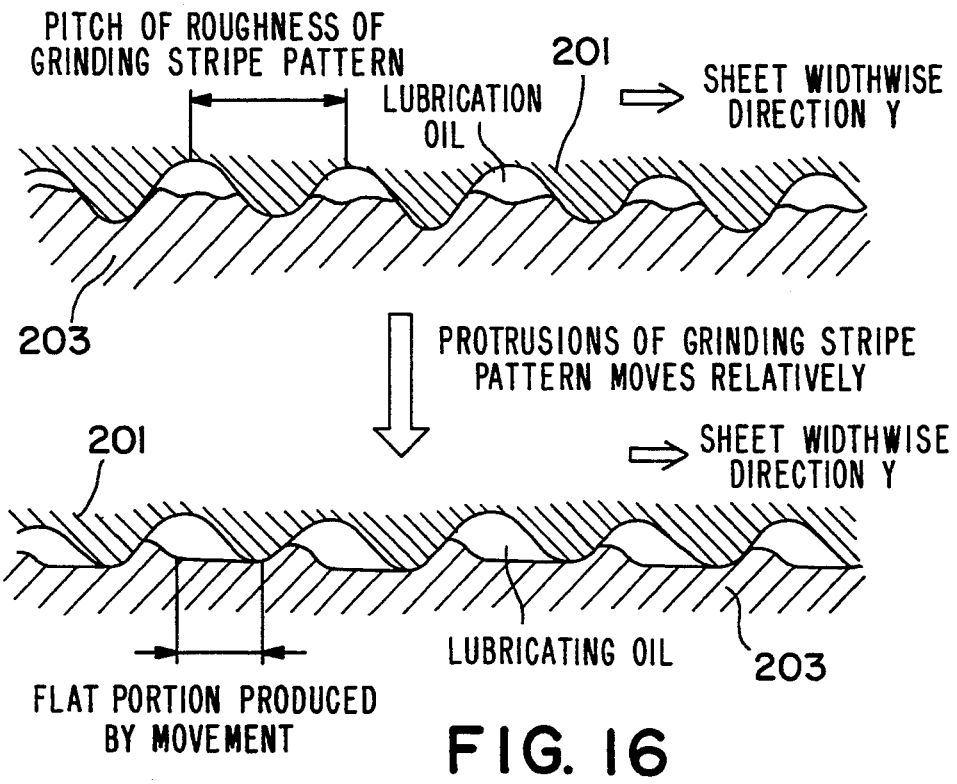
FIG. 16 is a cross-section view in the widthwise direction of a sheet for explaining a contact condition between work rolls and a metal sheet.
Figure 17:
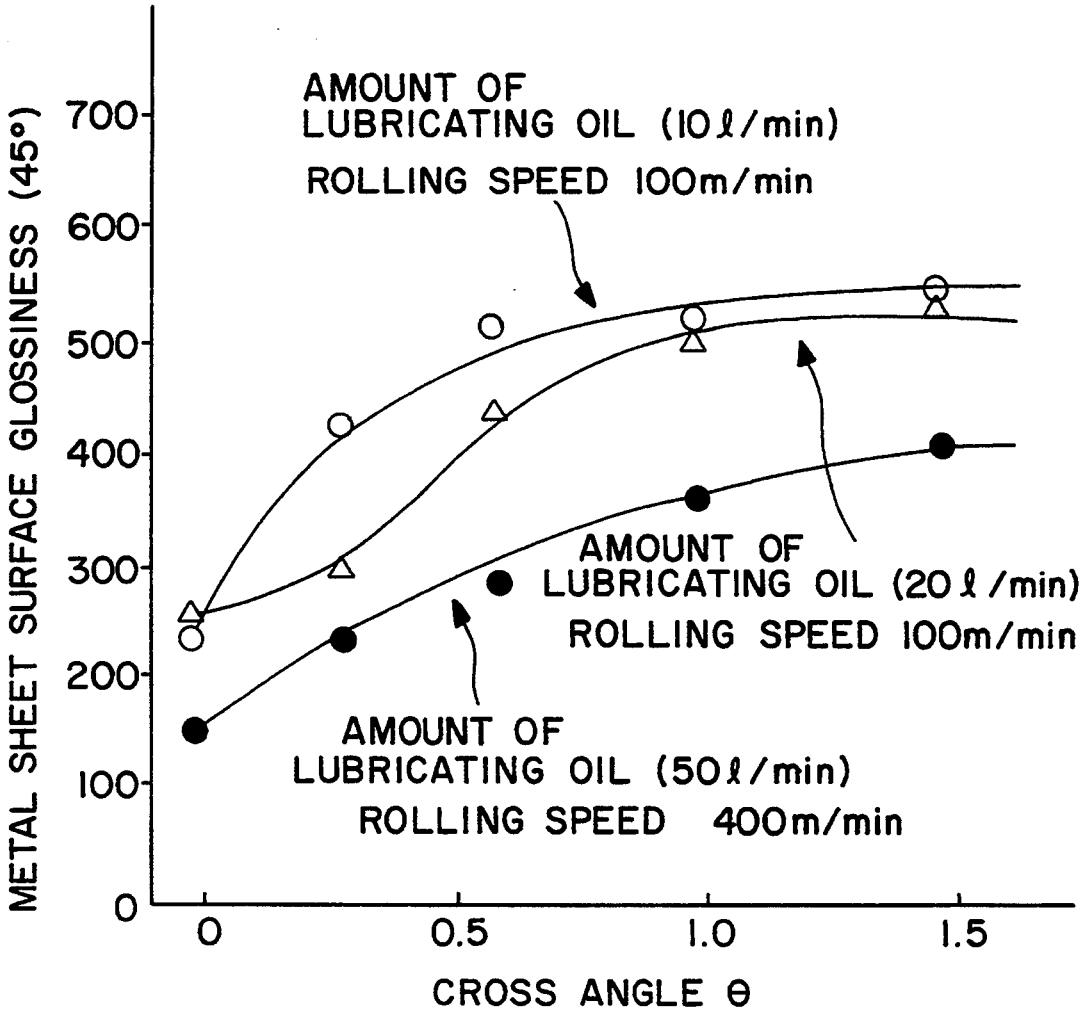
FIG. 17 is a diagram showing relations between a cross angle of work rolls and a surface glossiness of a metal sheet.
Figure 18:
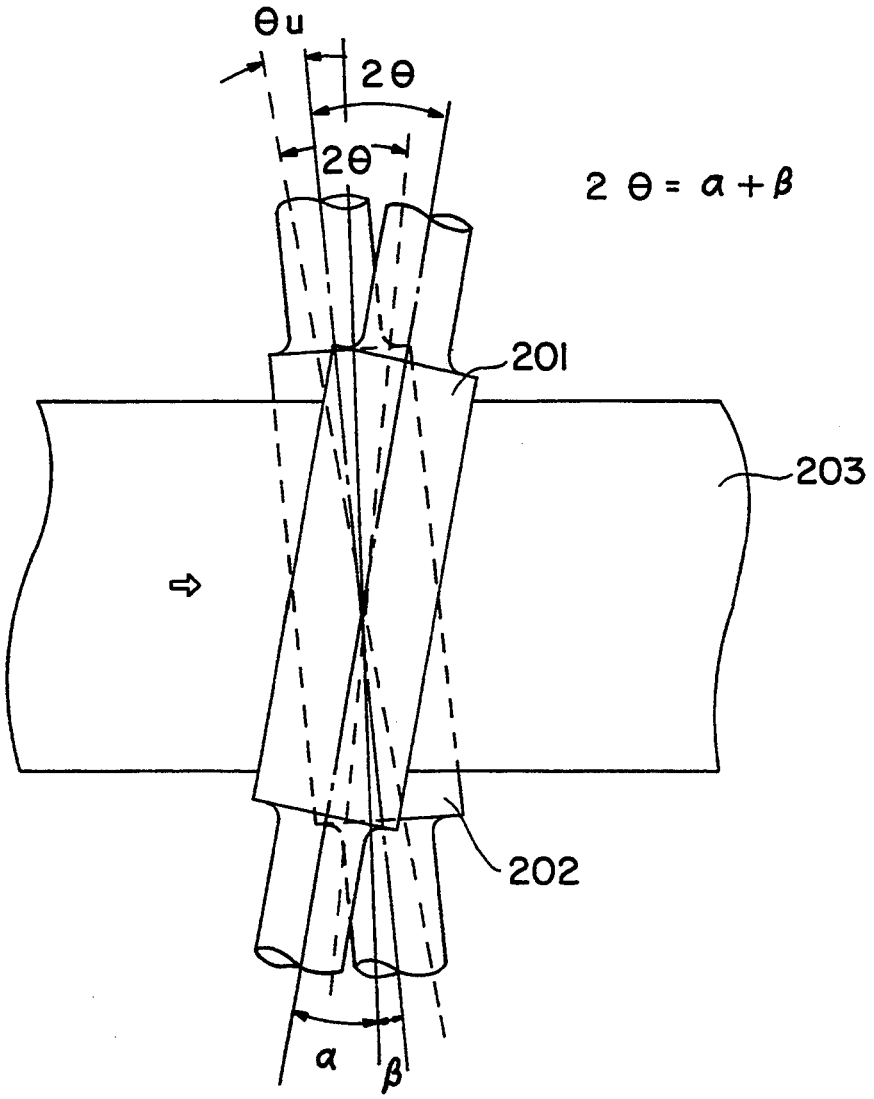
FIG. 18 is a plan view for explaining the state where the cross angles of the upper and lower rolls are made asymmetric.

In this preferred embodiment, as shown in FIG. 14, the angles formed between the axial directions of the upper and lower work rolls 201 and 202, respectively, and the direction at right angles to the rolling direction, that is, the cross angles $\alpha$ and $\beta$ are preset so as to fulfil the relations of $\alpha\beta\neq0$ and $\alpha-\beta\neq0$, and rolling is effected by these upper and lower work rolls 201 and 202.

The glossiness meters 204 measure the glossinesses of the upper and lower surfaces of a metal sheet, the measured glossinesses are input to an arithmetic unit 205, wherein a glossiness difference is calculated, a glossiness difference obtained as a result is input to a cross angle controller 206, thereby the cross angles $\alpha$ and $\beta$ of the upper and lower work rolls 201 and 202 are controlled, and a metal sheet having no glossiness difference between its opposite surfaces can be obtained.

In addition, when the cross angles $\alpha$ and $\beta$ are controlled in the above-described manner under the condition that a cross apex angle (a sum of cross angles) $\alpha+\beta$ of the upper and lower work rolls is kept constant, since a distance between the work rolls during rolling would substantially not vary, a difference in a glossiness between the upper and lower surfaces can be reduced without deforming a configuration of a metal sheet.

If cross angles of upper and lower rolls are different at the time of rolling, a metal sheet performs zig-zag traveling, and therefore, when the method according to the present invention is practiced, for instance, in the case where the method is applied to a tandem rolling mill, it is preferable to perform rolling with the direction of crossing of the rolls alternately interchanged at the respective stands.

Now, the advantages of the invention will be explained with reference to the following examples:

EXAMPLE 1

Pair cross cold-rolling of 1 pass was carried out by making use of a single stand 4Hi rolling mill employing rolls having a diameter of 400 mm and a surface roughness of 0.1 μm in Ra (center line average roughness) as upper and lower work rolls. As a metal sheet, a JIS SUS 430 stainless steel belt of 1.0 mm in thickness after annealing and pickling was used, and as lubricating oil, synthetic ester group rolling oil having a viscosity of 60 cSt at 40° C. was fed to the upper and lower work rolls at a rate of 20 liters/min in the form of an emulsion having a concentration of 3.0% and an average particle diameter of 5.5 μm. It is to be noted that with regard to a cross angle, two conditions of 0.5° and 1.0° were chosen as a reference, and the upper and lower rolls were disposed in the condition of being inclined in the symmetric directions with respect to the sheet widthwise direction. Furthermore, while a cross apex angle is kept constant, rolling was carried out as rotating in steps of 0.1° so that the cross angle on the side of the upper roll may become larger within a plane parallel to the plane of the rolled material. The rolling velocity was set at 450 m/min, and a depressing proportion was chosen to be 20%. In addition, similar rolling was carried out by making use of rolls having a surface roughness Ra of 0.3 μm.

A glossiness of the metal sheet after coldrolling at this time was measured by a glossiness meter having an incident angle of 45° as defined in JIS Z 8741. In Table-1 are shown the results of measurement. Also evaluation was made and disclosed in Table-1 such that tests resulted in a glossiness difference between the upper and lower surfaces of less than 10% were marked ⊙, those of 10% or more and less than 20% were marked o, those of 20% or more and less than 40% were marked Δ, and those of 40% or more were marked x.

viscosity of 60 cSt at 40° C. was fed to the upper and lower work rolls at a rate of 20 liters/min in the form of an emulsion having a concentration of 3.0% and an average particle diameter of 5.5 μm.

It is to be noted that as shown in FIG. 19, on the outlet side of the rolling mill are equipped glossiness meters 204 for measuring surface glossinesses of the metallic material after rolling, and on the upstream side of the meters are equipped dewatering air nozzles 207. By employing a difference in a glossiness between the upper and lower surfaces and a glossiness on the upper surface side measured by these glossiness meters 204 as a reference, a difference from a target value is calculated by the arithmetic unit 205, and it was transformed into a signal for controlling a cross angle. A cross angle controller 206 is provided with a mechanism for changing a cross angle between the upper and lower rolls on the basis of the signal.

At first, rolling was started with the upper and lower cross angles, respectively, set at 0.5°. Thereafter, while the rolling velocity is being varied from 10 m/min up to 500 m/min, rolling was carried out, in which the cross angles of the upper and lower work rolls are changed so that a glossiness difference between the upper and lower surfaces may be reduced. In order to limit variation of a configuration to a minimum extent, a cross apex angle was held at 1.5° at the maximum, and an amount of change of cross angles of the upper and lower rolls was set so as to be changed in the steps of 0.05°. Also, the glossiness difference between the upper and lower surfaces was set to be less than 10%. Change of the rolling conditions at this time is shown in Table-2, and results of measurement of a glossinesses are represented by solid lines in FIG. 20. In addition, results of measurement in the case where rolling was carried out with the upper and lower rolls arranged in parallel to each other (cross angles 0°) are represented by dash lines in FIG. 20, and a glossiness of a metal sheet in the case where rolling was carried out while keeping the

TABLE 1

| Groups | Test No. | Roll Roughness Ra (μm) | Cross angle Upper Roll α | Cross angle Lower Roll β | Cross Apex Angle α + β | Glossiness of Upper Surface of Metal Sheet ($G_5$ 45°) | Glossiness of Lower Surface of Metal Sheet ($G_5$ 45°) | Difference in Glossiness between Upper & Lower Surfaces |
|---|---|---|---|---|---|---|---|---|
| Examples | 1 | 0.1 | 0.6 | 0.4 | 1.0 | 220 | 255 | o |
| of | 2 | 0.1 | 0.7 | 0.3 | 1.0 | 240 | 250 | ⊙ |
| the | 3 | 0.1 | 1.2 | 0.8 | 2.0 | 345 | 405 | o |
| Present | 4 | 0.1 | 1.3 | 0.7 | 2.0 | 375 | 395 | ⊙ |
| Invention | 5 | 0.1 | 1.4 | 0.6 | 2.0 | 395 | 385 | ⊙ |
| | 6 | 0.3 | 0.6 | 0.4 | 1.0 | 295 | 335 | o |
| | 7 | 0.3 | 0.7 | 0.3 | 1.0 | 315 | 310 | ⊙ |
| | 8 | 0.3 | 1.2 | 0.8 | 2.0 | 355 | 395 | o |
| | 9 | 0.3 | 1.3 | 0.7 | 2.0 | 365 | 380 | ⊙ |
| | 10 | 0.3 | 1.4 | 0.6 | 2.0 | 370 | 365 | ⊙ |
| Examples | 11 | 0.1 | 0 | 0 | 0 | 110 | 140 | Δ |
| of | 12 | 0.1 | 0.5 | 0.5 | 1.0 | 200 | 265 | Δ |
| Contrast | 13 | 0.1 | 1.0 | 1.0 | 2.0 | 275 | 410 | x |
| | 14 | 0.3 | 0.5 | 0.5 | 1.0 | 260 | 345 | Δ |
| | 15 | 0.3 | 1.0 | 1.0 | 2.0 | 305 | 400 | Δ |

EXAMPLE 2

Pair cross cold-rolling of 1 pass was carried out by making use of a single stand 4Hi rolling mill employing rolls having a diameter of 400 mm and a surface roughness of 0.2 μm in Ra as upper and lower work rolls, similarly to the above-described Example 1. As a metal sheet, a JIS SUS 430 stainless steel belt of 1.0 mm in thickness after annealing and pickling was used, and as lubricating oil, synthetic ester group rolling oil having a cross angles of the upper and lower rolls constant and equal to each other without changing under control, was represented by dash-dot lines.

Figure 20:
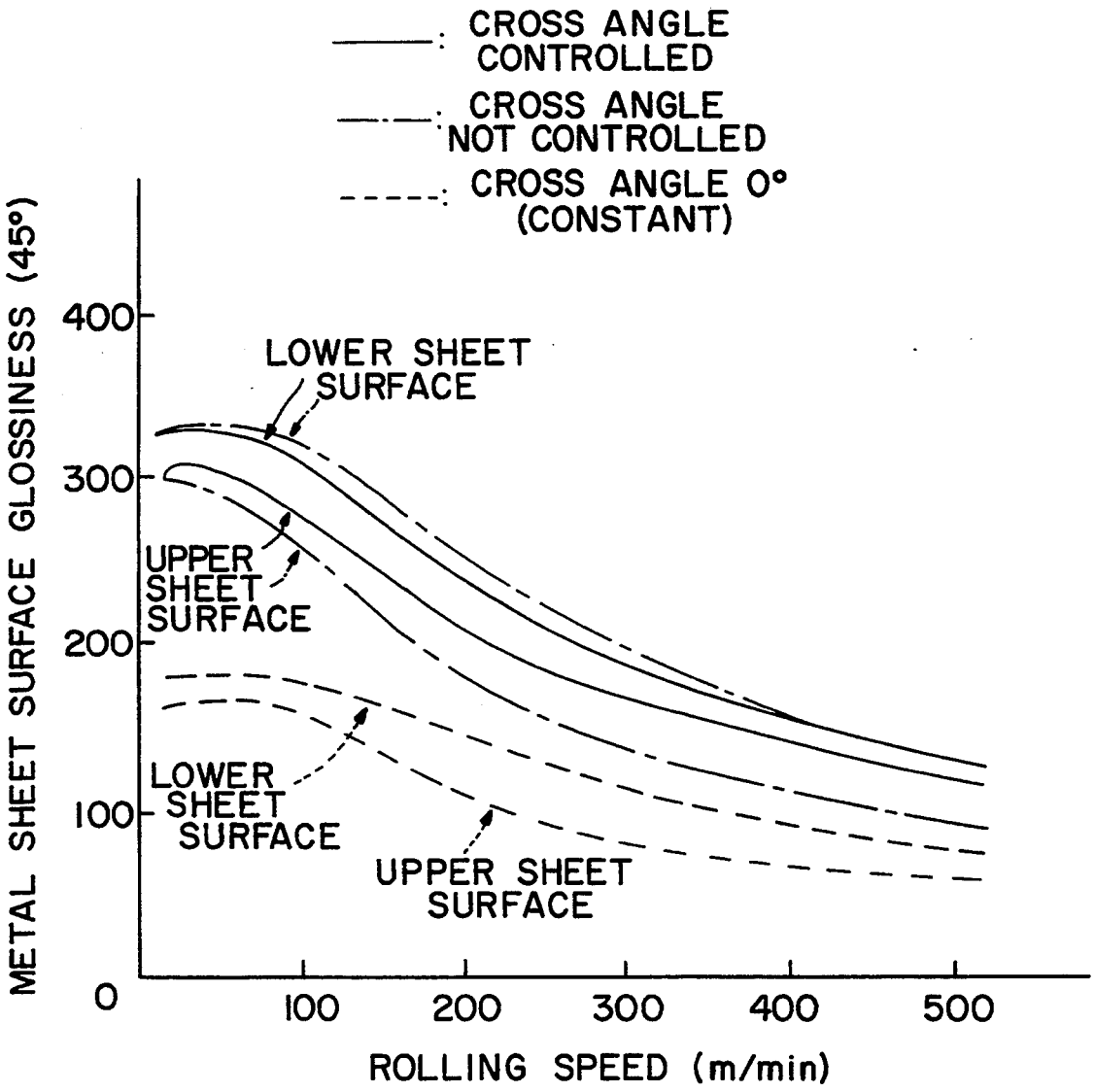
FIG. 20 is a diagram showing variations of glossinesses of the upper and lower surfaces of a metal sheet when rolling was effected while controlling the cross angles of the upper and lower work rolls.

As seen from FIG. 20, in the case where rolling was effected through the method according to the present invention, a glossiness is excellent as compared to the case where rolling was carried out with the upper and lower rolls held in parallel to each other, moreover even in the case where rolling was carried out with the upper and lower rolls crossed with each other, a glossiness would not be degraded as compared to the case where rolling was carried out with the upper and lower cross angles kept constant and not varied, and furthermore, a glossiness difference was also reduced.

TABLE 2

| | Rolling Velocity (m/min) | | | | | |
|---|---|---|---|---|---|---|
| | 10 | 100 | 200 | 300 | 400 | 500 |
| Cross Angle (°) | | | | | | |
| Upper Roll | 0.5 | 0.55 | 0.60 | 0.65 | 0.70 | 0.70 |
| Lower Roll | 0.5 | 0.45 | 0.45 | 0.45 | 0.50 | 0.50 |
| Apex Angle | 1.0 | 1.0 | 1.05 | 1.10 | 1.20 | 1.20 |

EXAMPLE 3

Figure 21:
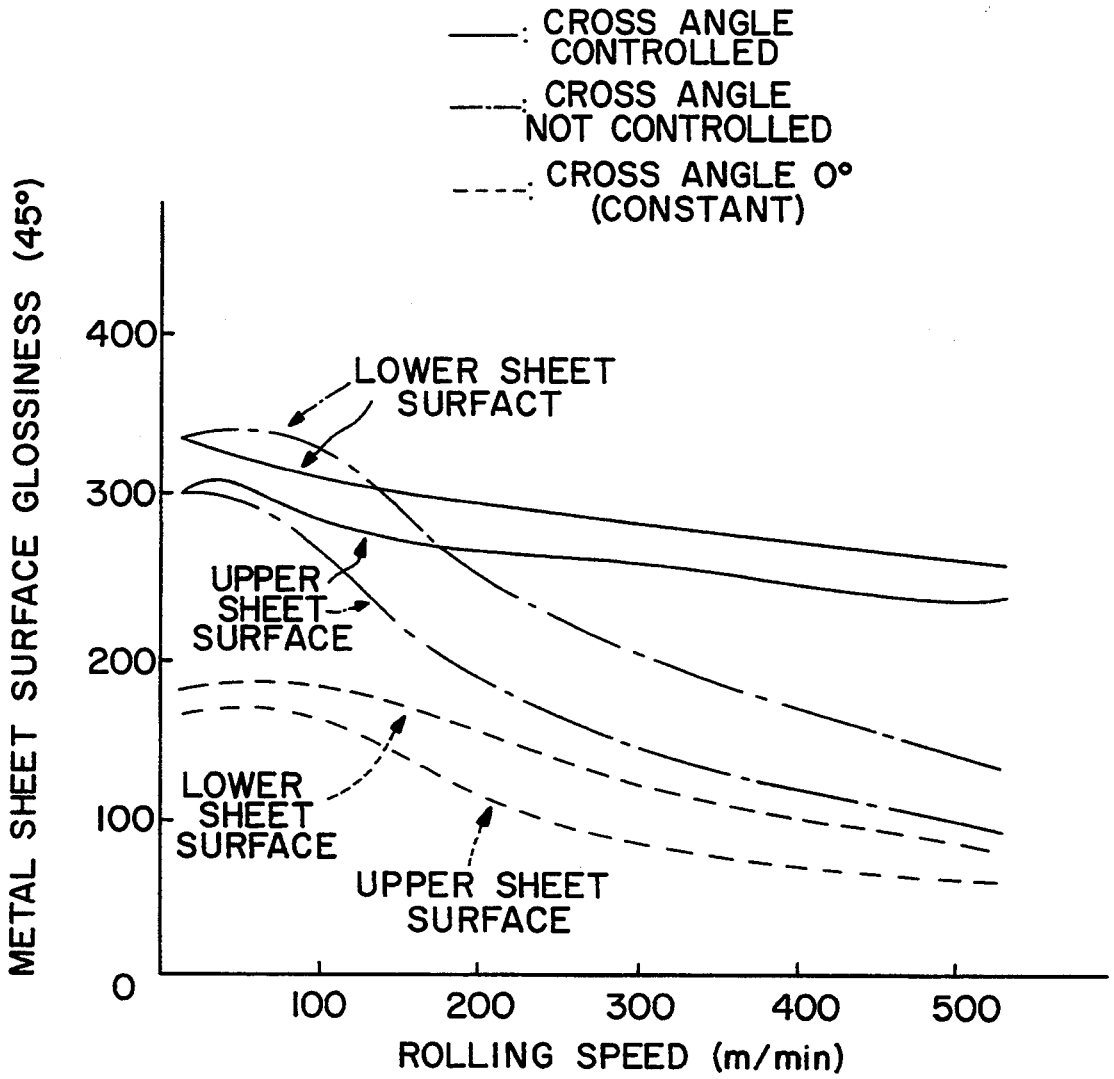
FIG. 21 is a similar diagram showing variations of glossinesses of the upper and lower surfaces of a metal sheet when rolling was effected while controlling the cross angles of the upper and lower work rolls.
Figure 22:
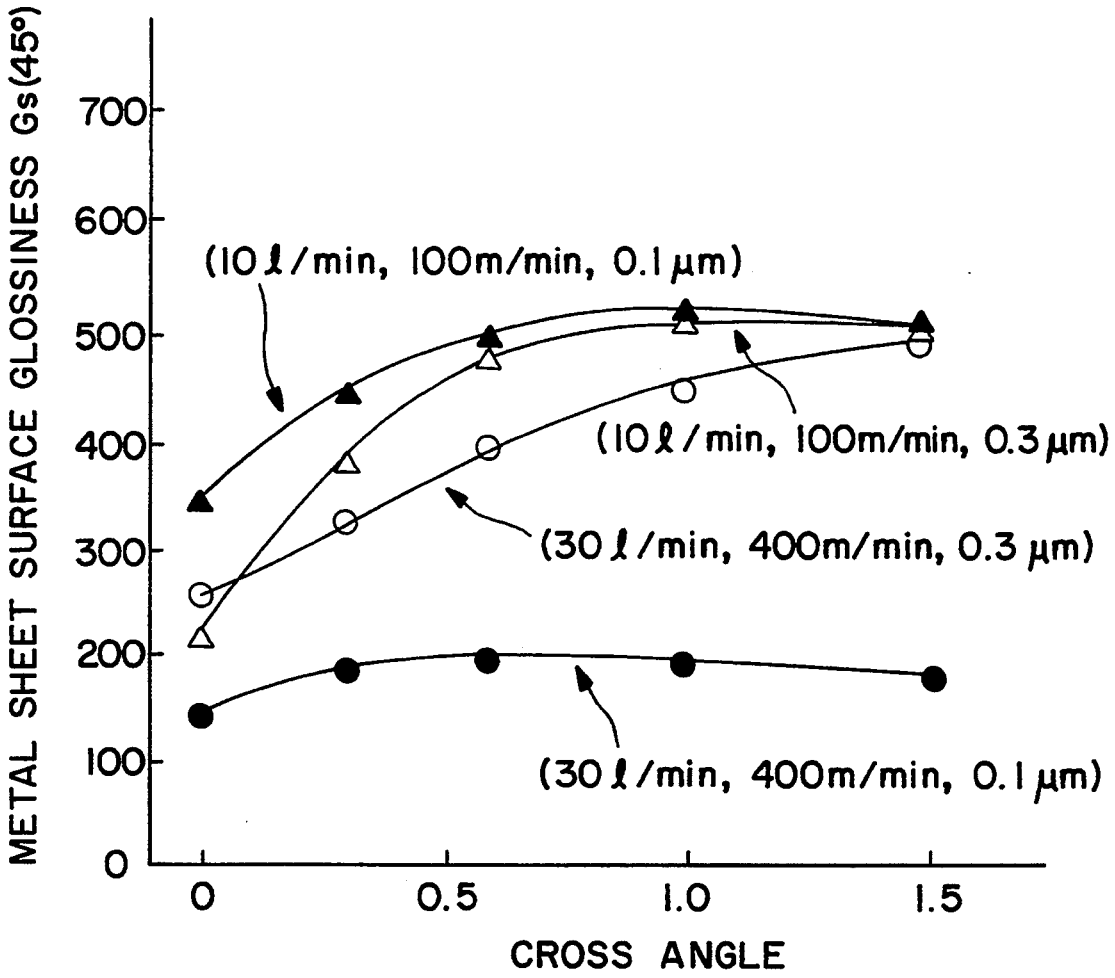
FIG. 22 is a diagram for explaining relations between cross angles of work rolls and surface glossinesses of a metal sheet for respective amounts of lubricating oil or respective surface roughnesses of rolls.
Figure 23:
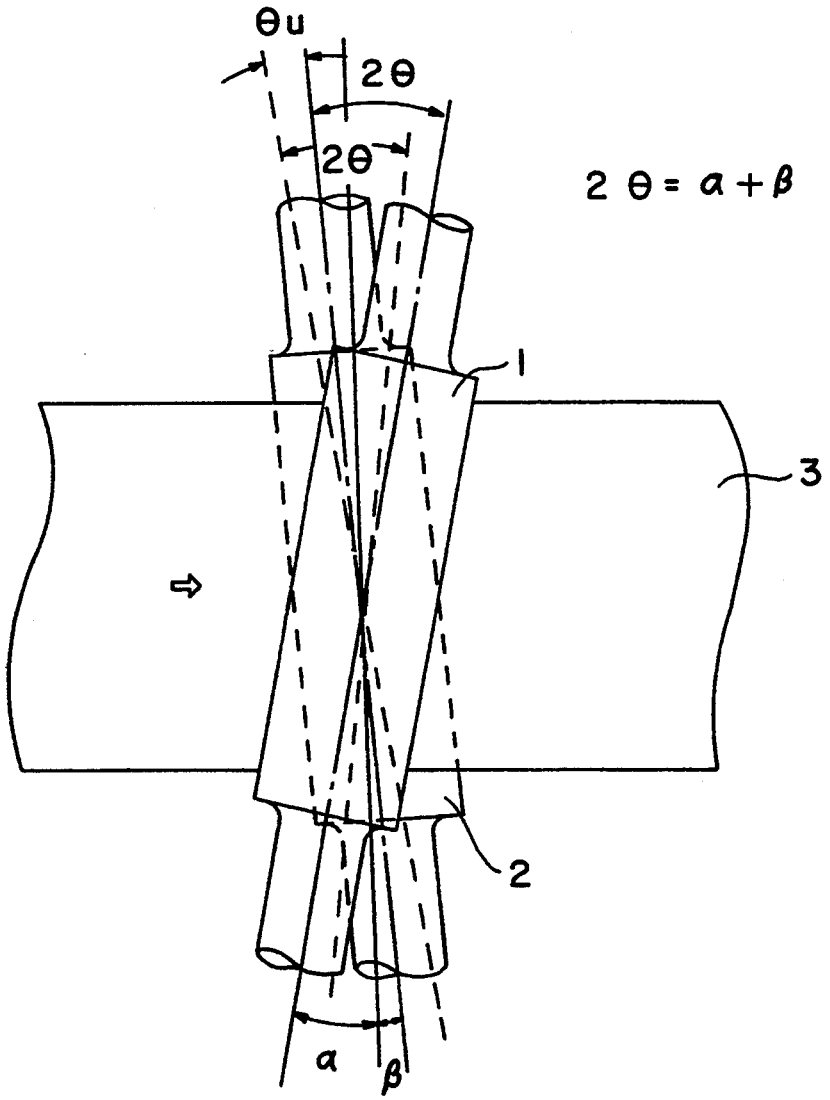
FIG. 23 is a plan view for explaining the state where the cross angles of the upper and lower work rolls according to the present invention are made asymmetric.

Under the same working conditions as the above-described Example 2, setting was effected so that glossinesses of the upper and lower surfaces may become 250 or more, and rolling was carried out while controlling cross angles. Variations of rolling conditions at that time are shown in Table-3, and results of measurement of glossinesses are shown in FIG. 21. It is seen that by adjusting the cross angles of the upper and lower rolls, a glossiness can be controlled at a high precision.

TABLE 3

| | Rolling Velocity (m/min) | | | | | |
|---|---|---|---|---|---|---|
| | 10 | 100 | 200 | 300 | 400 | 500 |
| Cross Angle (°) | | | | | | |
| Upper Roll | 0.5 | 0.55 | 0.65 | 0.75 | 0.80 | 0.80 |
| Lower Roll | 0.5 | 0.35 | 0.55 | 0.60 | 0.70 | 0.70 |
| Apex Angle | 1.0 | 0.9 | 1.20 | 1.35 | 1.50 | 1.50 |

Next, a fourth preferred embodiment of the present invention will be explained in the following. This preferred embodiment is an embodiment of the present invention described in the previous numbered paragraphs 4(*d*)–(*h*), which employs the system for controlling cross angles as shown in FIG. 19 in the rolling method making use of the apparatus shown in FIG. 14.

As the upper and lower work rolls 201 and 202 shown in FIG. 14, rolls having different surface roughness are used, and a difference in a glossiness between the upper and lower surfaces of a metal sheet 203 rolled by these can be reduced. Moreover, in addition to the abovementioned condition, by arranging the upper and lower work rolls 201 and 202 so as to have different cross angles $\alpha$ and $\beta$, a difference in a glossiness between the upper and lower surface of the metal sheet 203 can be reduced similarly to the third preferred embodiment. Furthermore, at this time, the glossiness difference between the upper and lower surfaces of the metal sheet after rolling is detected by means of the glossiness meters 204 shown in FIG. 19, similarly to the third preferred embodiment the above-described glossiness difference is reduced by controlling the cross angles $\alpha$ and $\beta$ via the arithmetic unit 205 and the cross angle controller 206, and also by controlling the cross angles $\alpha$ and $\beta$ in the above-described manner under the condition that the cross apex angle $(\alpha+\beta)$ is kept constant, a difference in glossinesses of the upper and lower surfaces can be reduced without deforming a configuration of a metal sheet.

In the following, advantages of the present invention will be explained.

EXAMPLE 4

Pair cross cold-rolling of 1 pass was carried out by making use of a single stand 4Hi rolling mill employing rolls having a diameter of 400 mm. As a metal sheet, a JIS SUS 430 stainless steel belt of 1.0 mm in thickness after annealing and pickling was used, and as lubricating oil, synthetic ester group rolling oil having a viscosity of 60 cSt at 40° C. was fed to the upper and lower work rolls at an equal rate in the form of emulsion having a concentration of 3.0% and an average particle diameter of 5.5 μm. It is to be noted that with regard to a cross angle, two conditions of 0.5° and 1.0° were chosen as a reference, and the upper and lower rolls were disposed in the condition of being inclined in the symmetric directions with respect to the sheet widthwise direction. Furthermore, while a cross apex angle is kept constant, rolling was carried out as rotating in steps of 0.1° so that the cross angle on the side of the upper roll may become larger within a plane parallel to the plane of the rolled material. The rolling velocity was set at 450 m/min, and a depressing proportion was chosen to be 20%. As the work rolls, rolls having a surface roughness of 0.15 μm, 0.2 μm and 0.3 μm in terms of Ra (center line average roughness) were used by being appropriately combined.

A glossiness of the metal sheet after coldrolling at this time was measured a glossiness meter having an incident angle of 45° as defined in JIS Z 8741. In Table-4 are shown the results of measurement. Also evaluation was made and disclosed in Table-4 such that tests resulted in a glossiness difference between the upper and lower surfaces of less than 10% were marked ⊙, those of 10% or more and less than 20% were marked o, those of 20% or more and less than 20% were marked Δ, and those of 40% or more were marked x.

As will be seen from Table-4, if a metal sheet is rolled through the method according to the present invention, even a metal sheet having an excellent glossiness of 400 or more, has a glossiness difference between upper and lower surfaces of less than 20%.

TABLE 4

| Groups | Test No. | Roll Roughness Ra (μm) | Roll Roughness Ra (μm) | Cross Angle Upper Roll $\alpha$ | Cross Angle Lower Roll $\beta$ | Cross Apex Angle $\alpha+\beta$ | Glossiness of Upper Surface of Metal Sheet ($G_s$ 45°) | Glossiness of Lower Surface of Metal Sheet ($G_s$ 45°) | Difference in Glossiness between Upper & Lower Surfaces |
|---|---|---|---|---|---|---|---|---|---|
| Examples of the Present Invention | 1 | 0.2 | 0.15 | 0.5 | 0.5 | 1.0 | 295 | 340 | o |
| | 2 | 0.2 | 0.15 | 0.6 | 0.4 | 1.0 | 305 | 325 | ⊙ |
| | 3 | 0.2 | 0.15 | 0.7 | 0.3 | 1.0 | 320 | 315 | ⊙ |
| | 4 | 0.2 | 0.15 | 1.2 | 0.8 | 2.0 | 385 | 410 | ⊙ |
| | 5 | 0.2 | 0.15 | 1.3 | 0.7 | 2.0 | 400 | 395 | ⊙ |
| | 6 | 0.2 | 0.15 | 1.4 | 0.6 | 2.0 | 405 | 355 | o |
| | 7 | 0.3 | 0.2 | 0.5 | 0.5 | 1.0 | 410 | 475 | o |
| | 8 | 0.3 | 0.2 | 0.6 | 0.4 | 1.0 | 425 | 455 | ⊙ |
| | 9 | 0.3 | 0.2 | 0.7 | 0.3 | 1.0 | 435 | 440 | ⊙ |
| | 10 | 0.3 | 0.2 | 1.2 | 0.8 | 2.0 | 475 | 530 | o |
| | 11 | 0.3 | 0.2 | 1.3 | 0.7 | 2.0 | 495 | 505 | ⊙ |
| | 12 | 0.3 | 0.2 | 1.4 | 0.6 | 2.0 | 500 | 485 | ⊙ |

TABLE 4-continued

| Groups | Test No. | Roll Roughness Ra (μm) | Roll Roughness Ra (μm) | Cross Angle Upper Roll α | Cross Angle Lower Roll β | Cross Apex Angle α + β | Glossiness of Upper Surface of Metal Sheet ($G_s$ 45°) | Glossiness of Lower Surface of Metal Sheet ($G_s$ 45°) | Difference in Glossiness between Upper & Lower Surfaces |
|---|---|---|---|---|---|---|---|---|---|
| | 13 | 0.2 | 0.25 | 1.6 | 0.4 | 2.0 | 485 | 470 | ◎ |
| Examples | 14 | 0.15 | 0.15 | 0 | 0 | 0 | 135 | 180 | Δ |
| of | 15 | 0.15 | 0.15 | 0.5 | 0.5 | 1.0 | 225 | 295 | Δ |
| Contrast | 16 | 0.15 | 0.15 | 1.0 | 1.0 | 2.0 | 290 | 420 | x |
| | 17 | 0.2 | 0.2 | 1.0 | 1.0 | 2.0 | 365 | 475 | Δ |
| | 18 | 0.3 | 0.3 | 1.0 | 1.0 | 2.0 | 430 | 525 | Δ |

As a metal sheet, a JIS SUS 430 stainless steel belt of 3.2 mm in thickness after annealing and pickling was used, and pair cross rolling was carried out at every stand in a 5-stand tandem rolling mill employing work rolls of 500 mm $\phi$ in diameter.

Cross angles and surface roughnesses of the work rolls in the first stand to the fifth stand are shown in Table-5, and arrangements of the work rolls in the respective stands are schematically shown in FIGS. 24(*a*-)-(*d*). It is to be noted that a cross angle of a roll is represented as positive in the case where the roll is inclined in the same direction as the upper work roll 201 in FIG. 14, but on the contrary, in the case where it is inclined in the same direction as the lower work roll 202 in the same figure, the cross angle is represented a negative. At this time, glossinesses of the metal sheet were all 500 or more, and glossiness differences were also less than 20%. In addition, an amount of zig-zag traveling when this rolling is being carried out was also marked ◎, Δ or x in Table-3 in the sequence of decrease of the amount. It is seen that the zig-zag traveling would become less if the magnitudes of the surface roughness or the cross directions of the upper and lower work rolls were to be alternately changed.

20 liters/min in the form of an emulsion having a concentration of 3.0% and an average particle diameter of 5.5 μm.

It is to be noted that as shown in FIG. 19, on the outlet side of the rolling mill are equipped glossiness meters 204 for measuring surface glossinesses of the metallic material after rolling, and at the upstream of them are equipped dewatering air nozzles 207. A glossiness difference between the upper and lower surfaces and a glossiness on the upper surface side measured by these glossiness meters 204 were taken as references, a difference from a target value was calculated by an arithmetic unit 205, and it was transformed into a signal for controlling the cross angles. A cross angle controller 206 is provided with a mechanism for varying the cross angles of the upper and lower rolls on the basis of the transformed signal.

At first, rolling was started with the upper and lower cross angles respectively set at 0.5°. Thereafter, while the rolling velocity is being varied from 10 m/min up to 500 m/min, rolling was carried out, in which cross angles of the upper and lower work rolls were changed so that a glossiness difference between the upper and lower surfaces may be reduced. In order to limit variation of a configuration to a minimum extent, a cross apex angle was held at 1.5° at the maximum, and an amount of change of cross angles of the upper and lower rolls was set so as to be changed in the steps of 0.05°. Also control was effected so that a glossiness of the upper surface may be 250 or more, and a glossiness difference between the upper and lower surface was set to be less than 10%. Change of the rolling conditions at this time is shown in Table-6, and results of measurement of a glossiness are represented by solid lines in

TABLE 5

| | | | 1 Stand | 2 Stand | 3 Stand | 4 Stand | 5 Stand | Glossiness | Difference of Glossiness | Amount of Zig-Zag Traveling |
|---|---|---|---|---|---|---|---|---|---|---|
| (1) | Cross Angles | Upper Roll | +1.2 | +1.2 | +0.7 | +0.6 | +0.6 | ◎ | ◎ | x |
| | | Lower Roll | −0.8 | −0.8 | −0.3 | −0.4 | −0.4 | | | |
| | Surface Roughness | Upper Roll | 0.3 | 0.3 | 0.2 | 0.2 | 0.2 | | | |
| | | Lower Roll | 0.2 | 0.2 | 0.15 | 0.15 | 0.15 | | | |
| (2) | Cross Angles | Upper Roll | +1.2 | −1.2 | +0.7 | −0.6 | +0.6 | ◎ | ◎ | ∘ |
| | | Lower Roll | −0.8 | +0.8 | −0.3 | +0.4 | −0.4 | | | |
| | Surface Roughness | Upper Roll | 0.3 | 0.3 | 0.2 | 0.2 | 0.2 | | | |
| | | Lower Roll | 0.2 | 0.2 | 0.15 | 0.15 | 0.15 | | | |
| (3) | Cross Angles | Upper Roll | +1.2 | +1.2 | +0.7 | 0.6 | +0.6 | ◎ | ◎ | Δ |
| | | Lower Roll | −0.8 | −0.8 | −0.3 | −0.4 | −0.4 | | | |
| | Surface Roughness | Upper Roll | 0.3 | 0.2 | 0.2 | 0.2 | 0.15 | | | |
| | | Lower Roll | 0.2 | 0.3 | 0.15 | 0.15 | 0.2 | | | |
| (4) | Cross Angles | Upper Roll | −1.2 | +1.2 | −0.7 | −0.6 | +0.6 | ◎ | ◎ | Δ |
| | | Lower Roll | +0.8 | −0.8 | +0.3 | +0.4 | −0.4 | | | |
| | Surface Roughness | Upper Roll | 0.2 | 0.3 | 0.2 | 0.15 | 0.2 | | | |
| | | Lower Roll | 0.3 | 0.2 | 0.15 | 0.2 | 0.15 | | | |

Note 1)
A cross angle of a roll is represented by a positive value in the case of inclination to the same direction as that shown in FIG. 14.
Note 2)
A surface roughness is a value represented in terms of a center line average roughness (Ra), and its unit is (μm).

EXAMPLE 6

Pair cross cold-rolling of 1 pass was carried out by making use of a single stand 4Hi rolling mill employing a roll having a diameter of 400 mm and a surface roughness of 0.25 μm in Ra as an upper work roll and a similar roll but having a surface roughness of 0.15 μm in Ra as a lower work roll. As a metal sheet, a JIS SUS 430 stainless steel belt of 1.0 mm in thickness after annealing and pickling was used, and as lubricating oil, synthetic ester group rolling oil having a viscosity of 60 cSt at 40° C. was fed to the upper and lower work rolls at a rate of FIG. 25. In addition, glossinesses of a metal sheet in the case where rolling was carried out with the cross angles of the upper and lower rolls kept equal to each other without changing under control, are shown by dash-dot lines, and those in the case where rolling was carried out with the upper and lower rolls arranged in parallel (cross angle 0°) (Ra 0.2 μm for both the upper and lower rolls) are shown by dash lines.

Figure 25:
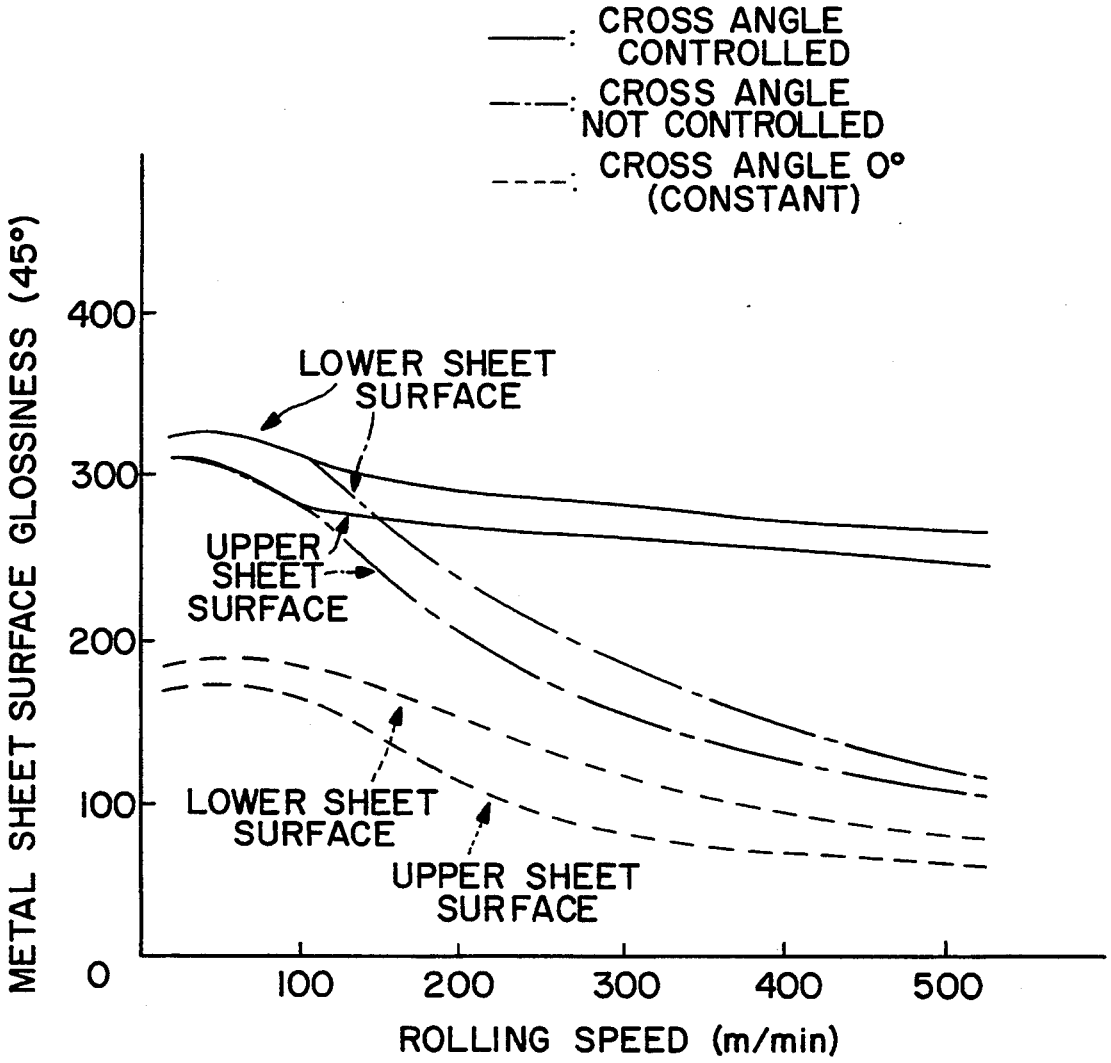
FIG. 25 is a diagram showing relations between changes of a rolling condition and glossinesses.

As seen from FIG. 25, in the case where rolling was effected through the method according to the present invention, a glossiness is excellent as compared to the case where rolls having equal surface roughnesses are arranged in parallel as the upper and lower work rolls. Furthermore, it can be seen that if rolling is carried out as controlling the cross angles of the rolls while the glossinesses of the upper and lower surfaces are being measured, then a rolled sheet having a good glossiness can be produced independently of variation of the rolling conditions.

TABLE 6

| | Rolling velocity (m/min) | | | | | |
|---|---|---|---|---|---|---|
| | 10 | 100 | 200 | 300 | 400 | 500 |
| Cross Angle (°) | | | | | | |
| Upper Roll | 0.5 | 0.5 | 0.55 | 0.60 | 0.65 | 0.65 |
| Lower Roll | 0.5 | 0.5 | 0.55 | 0.60 | 0.70 | 0.70 |
| Apex Angle | 1.0 | 1.0 | 1.10 | 1.20 | 1.35 | 1.35 |

As will be obvious from the detailed description of the present invention above, according to the present invention specifically defined in the appended claims, the following advantages are offered.

According to the method for shining metal sheet surfaces in a rolling process, since provision is made such that shear deformation is given in the sheet widthwise direction between a metal sheet and work rolls just before finishment of rolling, a glossiness of a metal sheet can be improved without lowering a productivity.

According to the method for shining metal sheet surfaces, as a result of the fact that when cold-rolling is effected with a metal sheet placed between a pair of work rolls, a sheet configuration of the metal sheet varied due to change of a cross angle between the work rolls can be connected by a configuration control actuator, control can be done so that both a surface glossiness and a sheet configuration may simultaneously fulfil target values, and it has become possible to produce a metal sheet product of high quality by rolling.

According to the method for cold-rolling metallic materials, a metal sheet having an excellent glossiness and moreover having no glossiness difference between its upper and lower surfaces can be obtained. Furthermore, since rolling can be achieved at a high speed by making use of a tandem rolling mill having a large roll diameter, even a thin stainless steel sheet for which a glossiness is taken severely, can be manufactured at a high efficiency.

Since many changes and modifications can be made to the above-described constructions without departing from the spirit of the present invention, it is intended that all matter contained in the above description and illustrated in the accompanying drawings shall be interpreted to be illustrative and not in a limiting sense.

What is claimed is:

1. A method for cold-rolling metallic materials, characterized in that roll cross rolling is carried out by installing work rolls in such manner that within a plane parallel to a rolling plane, angles $\alpha$ and $\beta$ formed by axial directions of the upper and lower work rolls, respectively, with respect to the direction at right angles to the rolling direction fulfil the conditions of $\alpha\beta \neq 0$ and $\alpha - \beta \neq 0$.

2. A method for cold-rolling metallic materials as claimed in claim 1, characterized in that a difference in a glossiness between the upper and lower surfaces of a metal sheet after the roll cross rolling is measured, and rolling is carried out while adjusting said angles $\alpha$ and $\beta$ so that said difference in the glossiness is reduced.

3. A method for cold-rolling metallic materials, as claimed in claim 1 or 2, characterized in that roll cross rolling is carried out while controlling said angles $\alpha$ and $\beta$ so that the sum of said angles $\alpha$ and $\beta$ is constant.

4. A method for cold-rolling metallic materials, characterized in that at the time of carrying out roll cross rolling, in which metallic materials are rolled by crossing the axes of at least the upper and lower work rolls within a plane parallel to a rolling plane, rolls having different surface roughnesses are employed as the upper and lower work rolls, and wherein the upper and lower work rolls are installed in such manner that within a plane parallel to a rolling plane, angles $\alpha$ and $\beta$ formed by axial directions of the upper and lower work rolls, respectively, with respect to the direction at right angles to the rolling direction are different.

5. A method for cold-rolling metallic materials as claimed in claim 4, characterized in that a difference in a glossiness between the upper and lower surfaces of a metallic sheet after the roll cross rolling is measured, and rolling is carried out while adjusting said angles $\alpha$ and $\beta$ so that said difference in the glossiness is reduced.

6. A method for cold-rolling metallic materials as claimed in claim 4 or 5, characterized in that roll cross rolling is carried out while controlling said angles $\alpha$ and $\beta$ so that the sum of said angles $\alpha$ and $\beta$ is constant.

7. A method for cold-rolling metallic materials as claimed in any one of claims 4 or 5, characterized in that at the time of carrying out roll cross rolling by means of successive stands, rolling is effected by alternately interchanging surface roughnesses and/or cross-directions of the upper and lower work rolls in the respective stands.

* * * * *